US008184140B2

(12) United States Patent
Sowa et al.

(10) Patent No.: US 8,184,140 B2
(45) Date of Patent: May 22, 2012

(54) LINE HEAD AND IMAGE FORMING APPARATUS

(75) Inventors: Takeshi Sowa, Matsumoto (JP); Yujiro Nomura, Shiojiri (JP); Ryuta Koizumi, Shiorjiri (JP)

(73) Assignee: Seiko Epson Corporation, Tokyo (JP)

( * ) Notice: Subject to any disclaimer, the term of this patent is extended or adjusted under 35 U.S.C. 154(b) by 379 days.

(21) Appl. No.: 12/628,868

(22) Filed: Dec. 1, 2009

(65) Prior Publication Data

US 2010/0183336 A1 Jul. 22, 2010

(30) Foreign Application Priority Data

Jan. 22, 2009 (JP) ..... 2009-012420

(51) Int. Cl.
*B41J 2/45* (2006.01)
*B41J 15/14* (2006.01)
*B41J 27/00* (2006.01)

(52) U.S. Cl. ..... 347/238; 347/244; 347/258

(58) Field of Classification Search ..... 347/230, 347/238, 241, 244, 256, 258; 359/619, 626
See application file for complete search history.

(56) References Cited

U.S. PATENT DOCUMENTS

| | | | | |
|---|---|---|---|---|
| 5,023,442 | A | 6/1991 | Taniguchi et al. | 250/208.1 |
| 5,210,398 | A * | 5/1993 | Metlitsky | 235/462.24 |
| 6,543,693 | B1 * | 4/2003 | Stern et al. | 235/462.35 |
| 2009/0244713 | A1 * | 10/2009 | Kodera et al. | 359/619 |

FOREIGN PATENT DOCUMENTS

| | | |
|---|---|---|
| JP | 02-004546 | 1/1990 |

* cited by examiner

*Primary Examiner* — Hai C Pham
(74) *Attorney, Agent, or Firm* — DLA Piper LLP (US)

(57) ABSTRACT

An optical system of a line head images light emitted from first and second light emitting elements and includes a rotationally symmetric lens having a lens face. A first region of the lens face includes an intersection point of the lens face with the symmetry axis of the lens, and a second region surrounding a periphery of the first region. The shape of a boundary portion between the first and second regions has the relationship $0.5\omega<\Delta\theta$, wherein $\omega$ is a first direction angle that a first chief ray emitted by the first light emitting element makes with a second chief ray emitted by the second light emitting element, and $\Delta\theta$ is an angle that a tangent line to the first region at the boundary portion makes with a tangent line to the second region at the boundary portion in a first direction cross-section including the symmetry axis.

6 Claims, 20 Drawing Sheets

EXAMPLE 1

COMPARATIVE EXAMPLE 1

LINE HEAD AND IMAGE FORMING APPARATUS

BACKGROUND

1. Technical Field

The present invention relates to a line head and an image forming apparatus provided with the line head.

2. Related Art

An image forming apparatus has been conventionally used in the forming of an image on a recording medium. In such an image forming apparatus, a photo conductor of a circular column shape (cylindrical shape), an electrification unit which uniformly electrifies a light receiving surface of the photo conductor, an exposure unit (line head) which forms an electrostatic latent image on the light receiving surface by emitting light such as a laser onto a desired position of the uniformly electrified light receiving surface, and the like are provided.

Further, as the exposure unit (line head) which is provided in the image forming apparatus, there is known an optical information writing device having a plurality of LED chip arrays arranged in a line in the axial direction of the photo conductor, and an optical lens system which is provided with a plurality of lens elements each provided corresponding to each LED chip array (for example, JP-A-2-4546).

In the optical information writing device described in JP-A-2-4546, the optical lens system is disposed such that the light from each LED chip array is imaged on the light receiving surface of the photo conductor (that is, a spot diameter on the light receiving surface is minimized), and, for example, by independently controlling the ON/OFF timing of the driving (light emission) of each LED, it is possible to form a desired latent image on the light receiving surface.

Here, it is difficult to make the transverse cross-sectional shape of the photo conductor into an exact circle in terms of technology and cost, and even if it is possible to make the transverse cross-sectional shape of the photo conductor into an exact circle, its shape varies according to the usage environment (atmosphere temperature or external force), the deterioration of the light receiving surface, or the like, whereby there is also a case where the transverse cross-sectional shape does not become an exact circle. In this manner, in a case where the transverse cross-sectional shape of the photo conductor is not an exact circle, at a first point on the light receiving surface, the light receiving surface is coincident with an imaging point, but, at a second point different from the first point, the light receiving surface is not coincident with the imaging point. In this manner, a difference occurs in the size of the spot at the first point and the second point, so that it is not possible to form spots of a uniform size with respect to the entire area of the light receiving surface.

Further, as described above, although the exposure unit is provided so as to minimize the spot diameter on the light receiving surface, in a case where the installation position of the exposure unit has deviated from a predetermined position (that is, in a case where the separation distance between the exposure unit and the photo conductor has deviated from a predetermined value), the spot diameter on the light receiving surface becomes larger than the predetermined diameter.

As described above, in the optical information writing device described in JP-A-2-4546, it is difficult to form a spot having a desired diameter on the light receiving surface, so that there is a problem that it is difficult to form a desired latent image.

SUMMARY

An advantage of some aspects of the invention is that it provides a line head capable of forming spots of a uniform size on a light receiving surface, and an image forming apparatus provided with the line head.

According to a first aspect of the invention, there is provided a line head including: first and second light emitting elements disposed in a first direction; and an optical system optical system which images the light emitted from the first and second light emitting elements, wherein the optical system includes a rotationally symmetrical lens having a lens face including first and second regions which are defined by different definition expressions; the first region is formed to include an intersection point of the lens face with the symmetry axis of the rotationally symmetrical lens; the second region is formed to surround the periphery of the first region; and a first chief raychief ray of a first light flux which is emitted from the first light emitting element and imaged by the optical system, a second chief raychief ray of a second light flux which is emitted from the second light emitting element and imaged by the optical system, and the shape of the boundary portion between the first region and the second region of the lens face have the following relationship:

$$0.5\omega<\Delta\theta$$

wherein in the above formula, $\omega$ is a first direction angle that the first chief ray makes with the second chief ray, and $\Delta\theta$ is an angle that a tangent line to the first region at the boundary portion makes with a tangent line to the second region at the boundary portion in a first direction cross-section including the symmetry axis.

In the line head according to this aspect, it is preferable that three or more light emitting elements including the first light emitting element and the second light emitting element be disposed in the first direction, and the first light emitting element and the second light emitting element be disposed adjacent to each other in the first direction.

In the line head according to this aspect, it is preferable that a light emitting element where a separation distance in the first direction from the symmetry axis is the shortest, among the three or more light emitting elements, be the first light emitting element.

In the line head according to this aspect, it is preferable that when the rotationally symmetrical lens is viewed from the direction of the symmetry axis, the area of the second region be smaller than the area of the first region.

In the line head according to this aspect, it is preferable that the $\Delta\theta$ has the relationship of $\Delta\theta>0.261$.

According to a second aspect of the invention, there is provided an image forming apparatus including: a latent image supporting body on which a latent image is formed; and a line head which exposes the latent image supporting body, thereby forming the latent image, wherein the line head includes first and second light emitting elements disposed in a first direction, and an optical system which images the light emitted from the first and second light emitting elements; the optical system includes a rotationally symmetrical lens having a lens face including first and second regions which are defined by different definition expressions; the first region is formed to include an intersection point of the lens face with the symmetry axis of the rotationally symmetrical lens; the second region is formed to surround the periphery of the first region; and a first chief ray of a first light flux which is emitted from the first light emitting element and imaged by the optical system, a second chief ray of a second light flux which is emitted from the second light emitting element and imaged by the optical system, and the shape of the boundary portion between the first region and the second region of the lens face have the following relationship:

$$0.5\omega<\Delta\theta$$

wherein in the above formula, ω is a first direction angle that the first chief ray makes with the second chief ray, and Δθ is an angle that a tangent line to the first region at the boundary portion makes with a tangent line to the second region at the boundary portion in a first direction cross-section including the symmetry axis.

According to the invention, even if a relative position relation (separation distance) with the light receiving surface has deviated from a predetermined value, or a separation distance from the light receiving surface varies according to driving, it is possible to form spots of a uniform and desired size on the light receiving surface, and thus form a desired latent image. Also, lens design capable of regularly forming the first region and the second region becomes easier.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the line head and the image forming apparatus of the invention will be explained on the basis of the preferred embodiment shown in the accompanying drawings.

Figure 1:
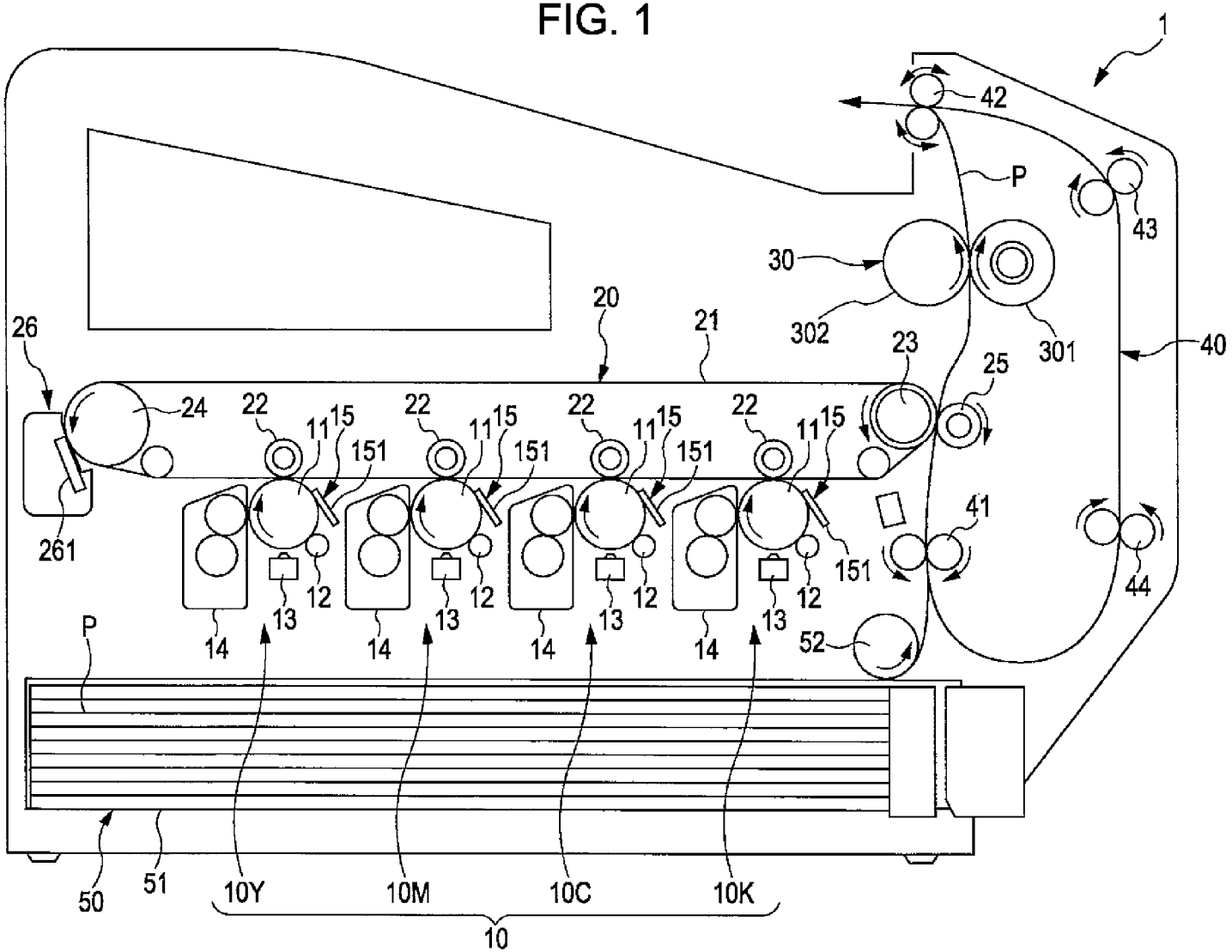
FIG. 1 is a schematic view showing the entire configuration of the image forming apparatus of the invention.
Figure 2:
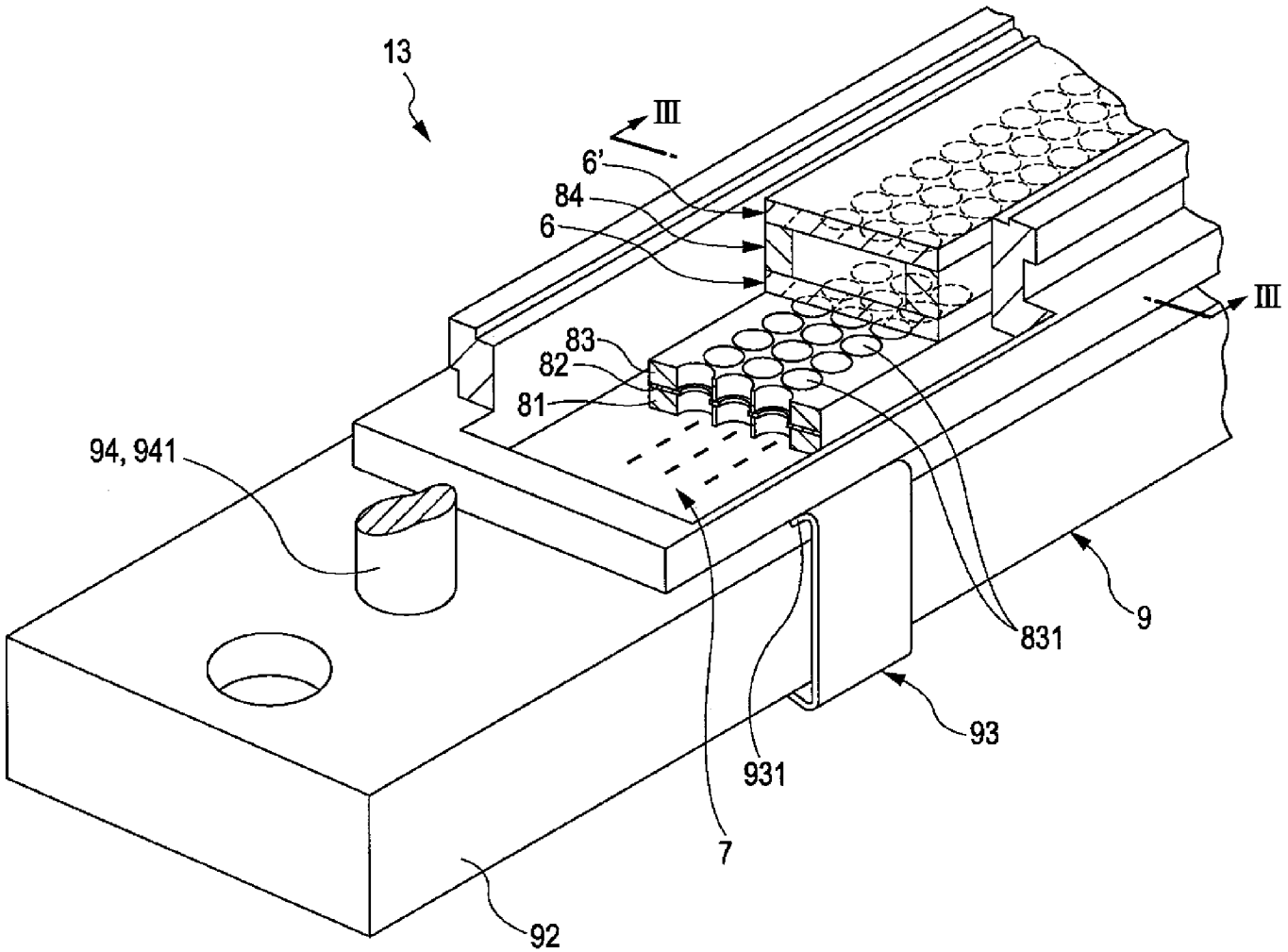
FIG. 2 is a perspective view, partially in cut away, of the line head of the invention, which is provided in the image forming apparatus shown in FIG. 1.
Figure 3:
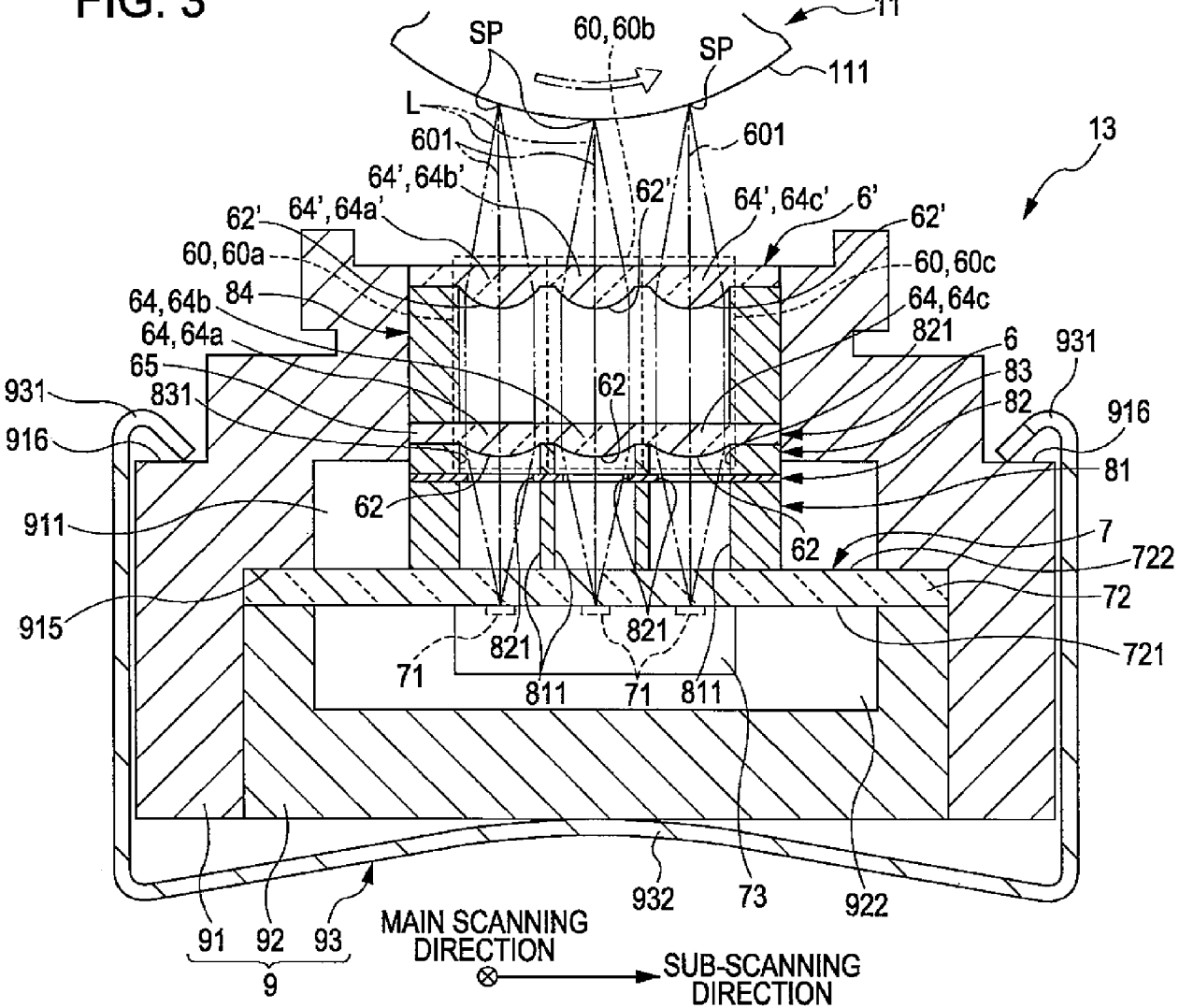
FIG. 3 is a cross-sectional view taken along line III-III of FIG. 2.
Figure 4:
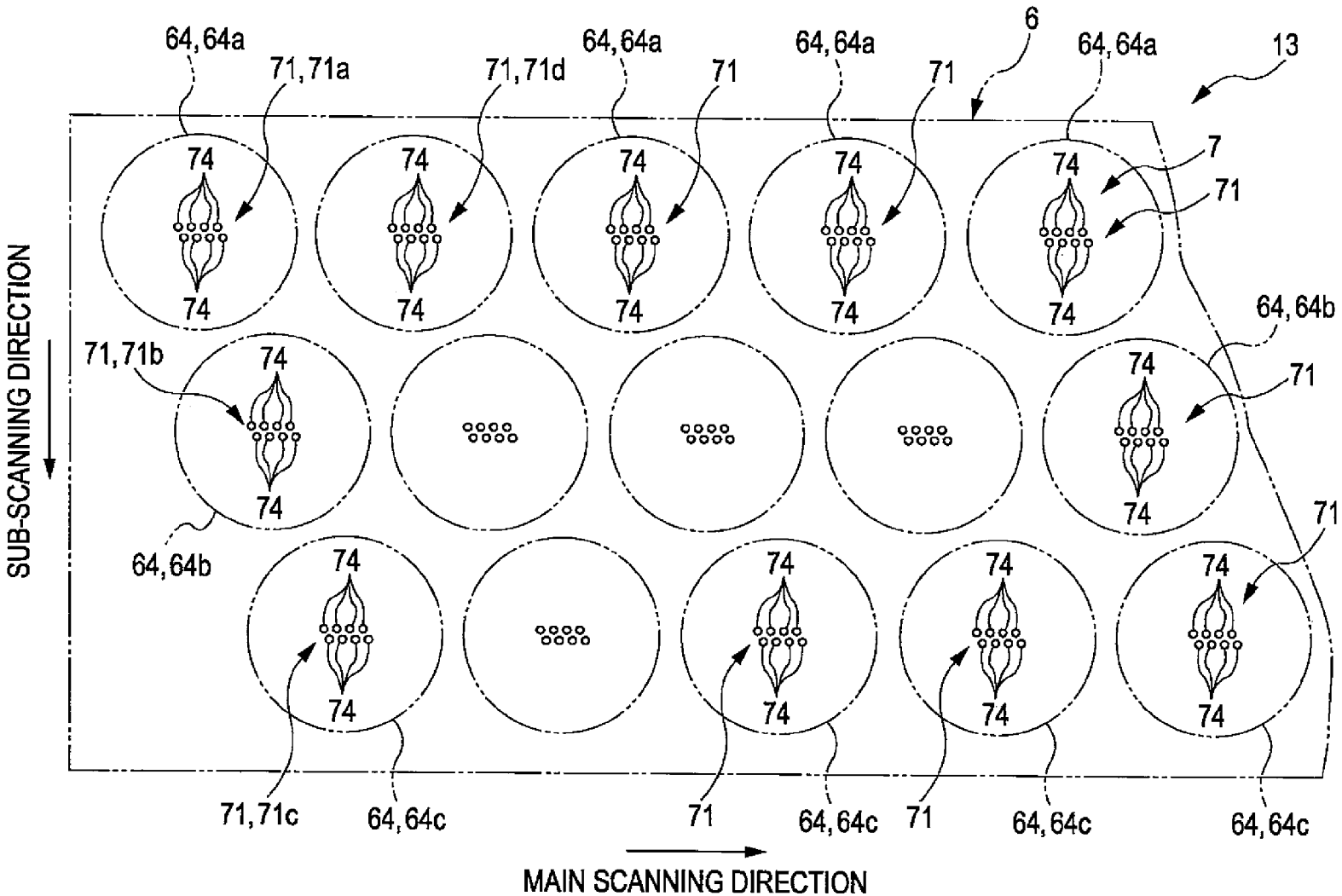
FIG. 4 is a plan view of the line head shown in FIG.
Figure 5A:
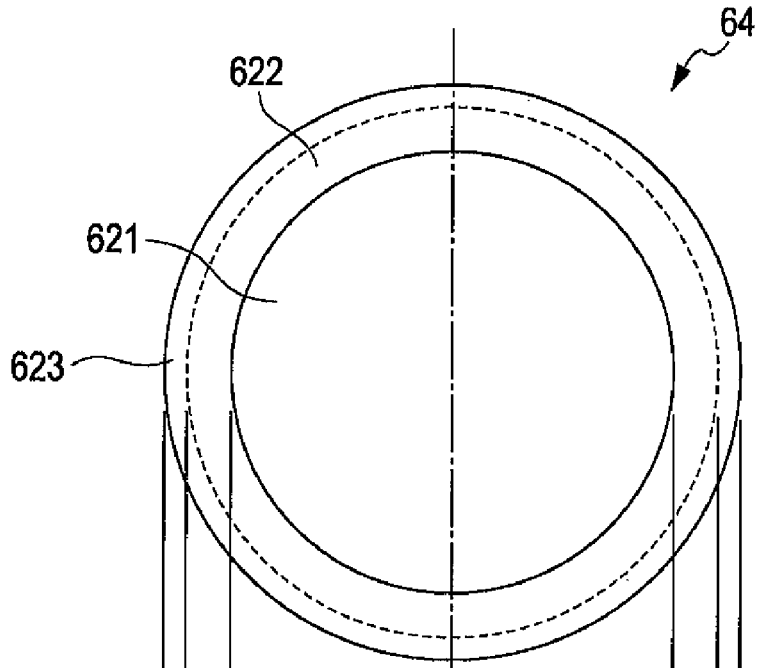
FIGS. 5A and 5B respectively are a plan view and a cross-sectional view of a lens which is included in the line head shown in FIG. 2.
Figure 5B:
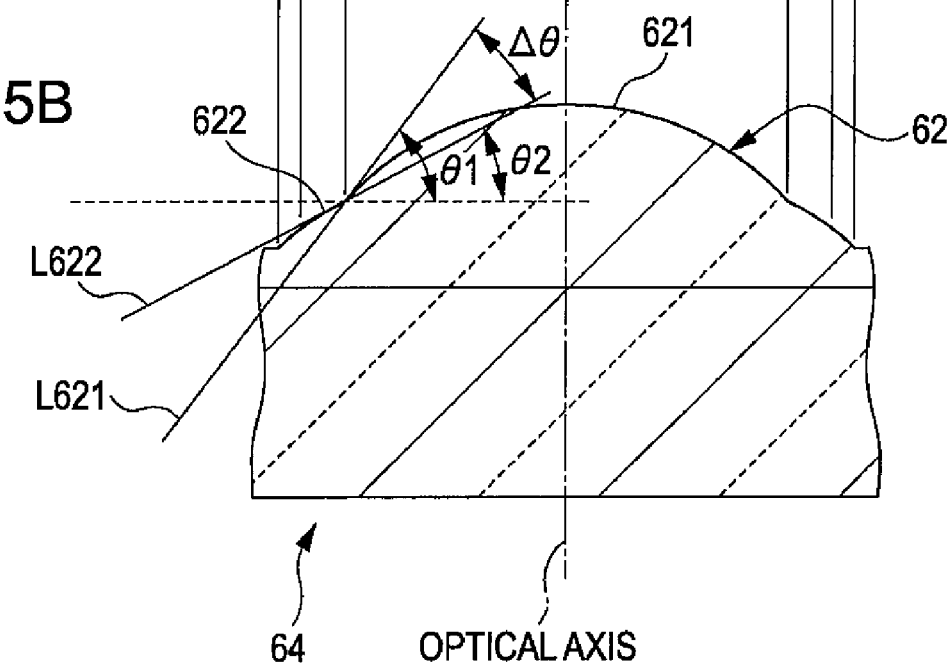
Figure 6:
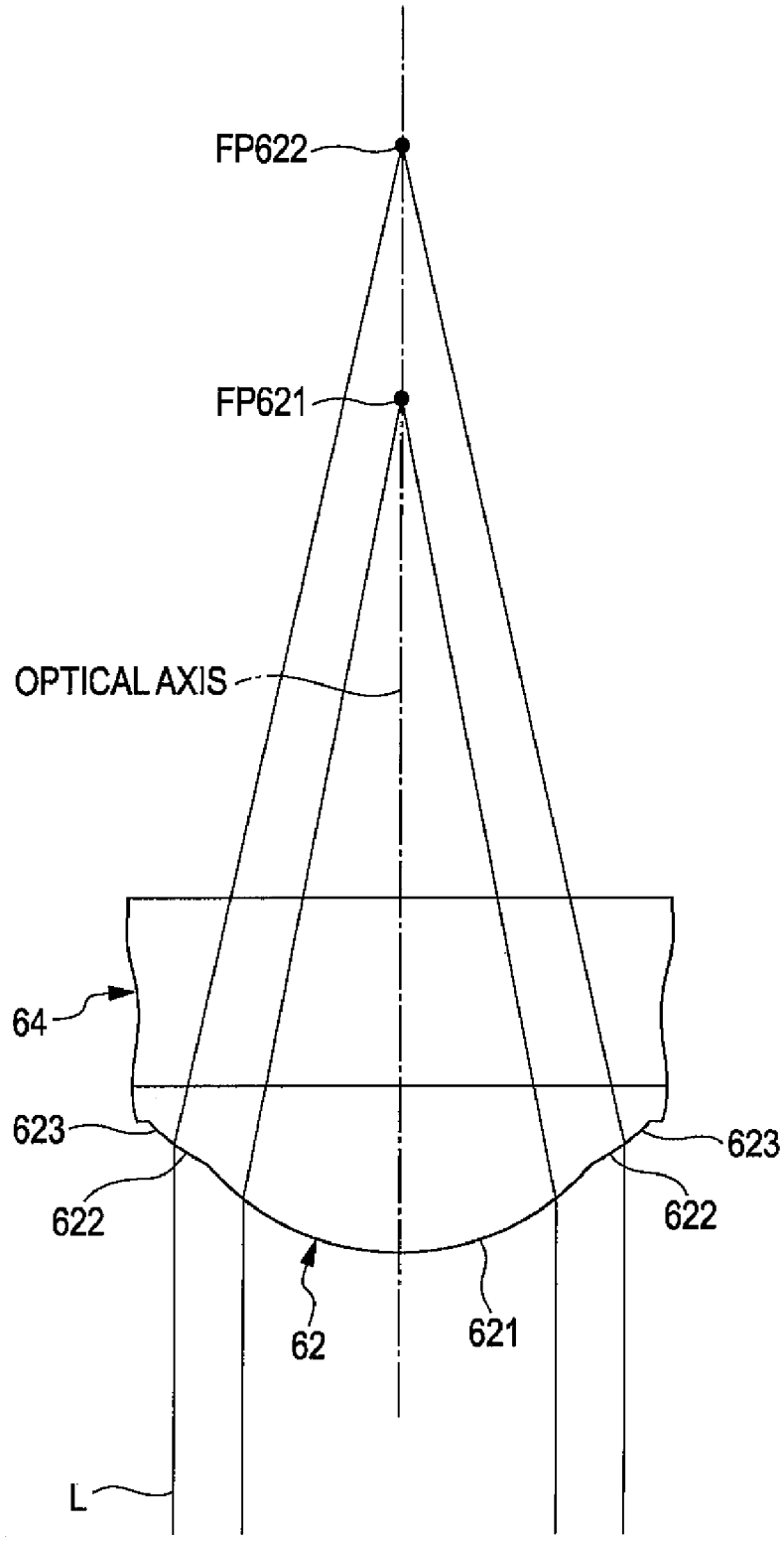
FIG. 6 is a view showing a focal point of the lens shown in FIGS. 5A and 5B.
Figure 7:
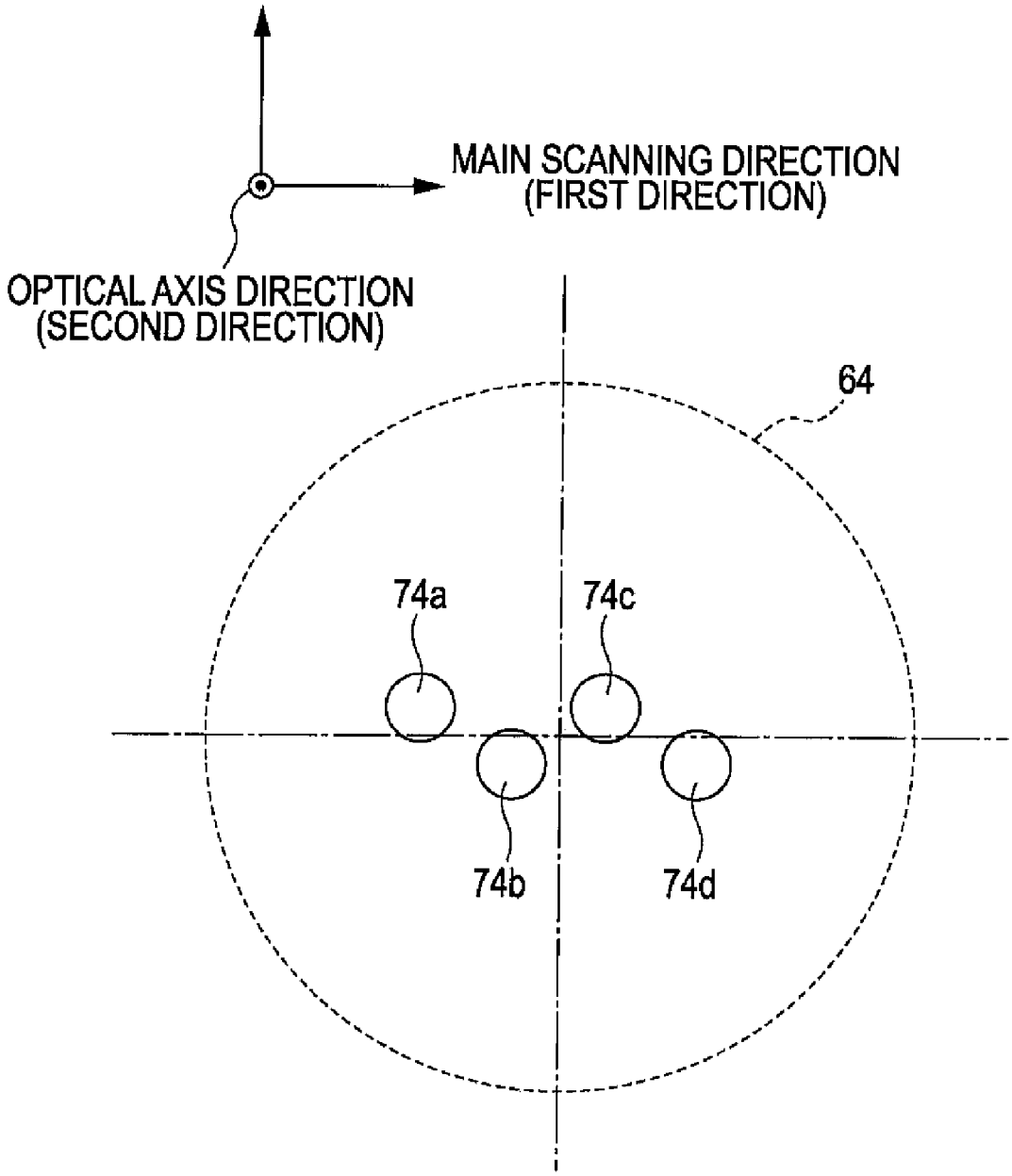
FIG. 7 is a view showing four light emitting elements which are adjacent to each other in a main scanning direction (a first direction).
Figure 8:
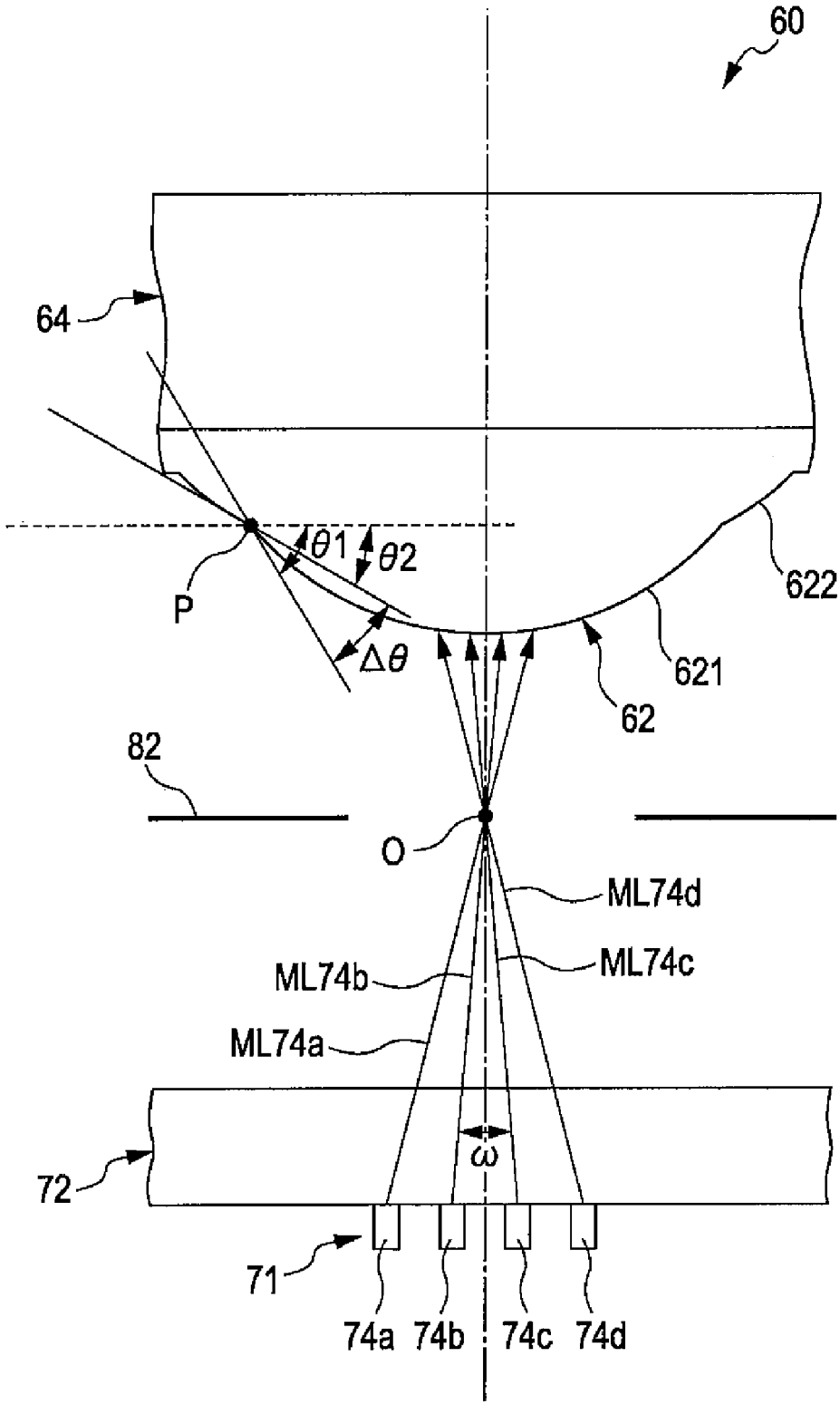
FIG. 8 is a view showing a chief ray of the light emitted from the light emitting elements which are included in the line head shown in FIG. 2.
Figure 10:
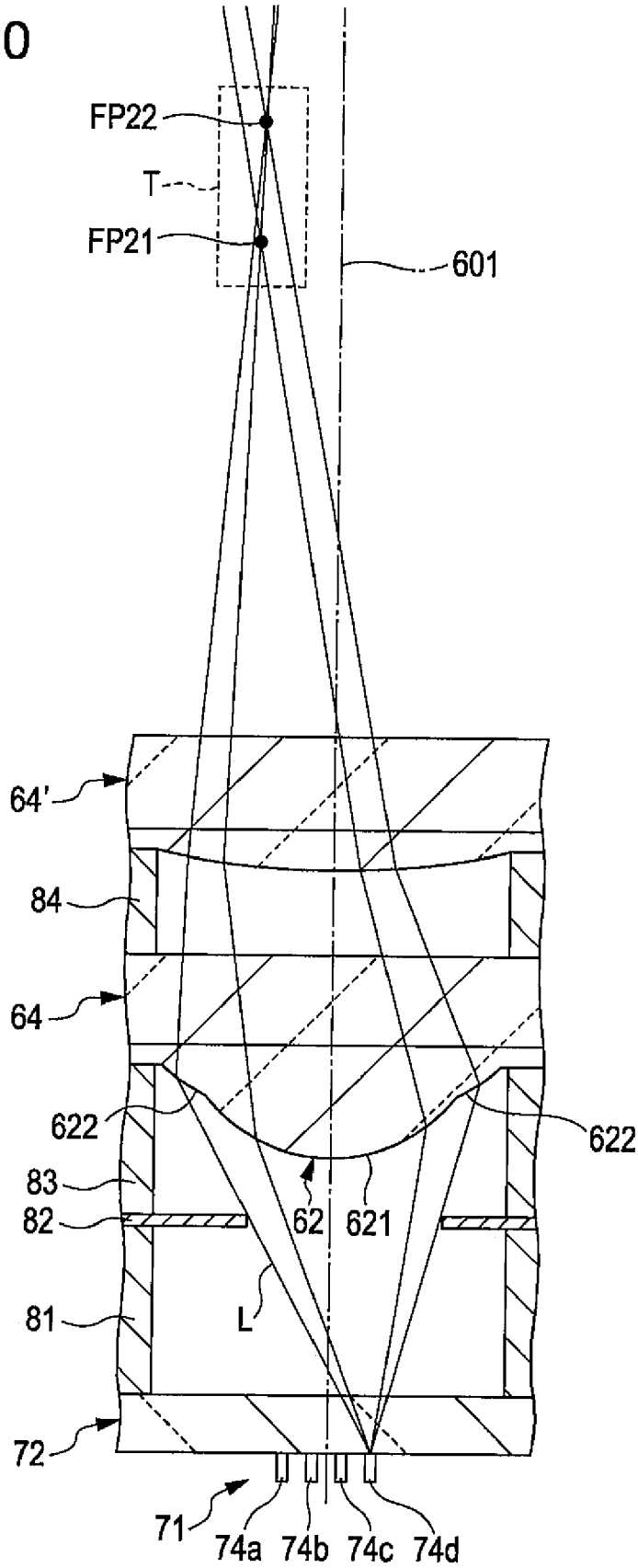
FIG. 10 is a view showing an imaging point of the optical system which is included in the line head shown in FIG. 2.
Figure 11:
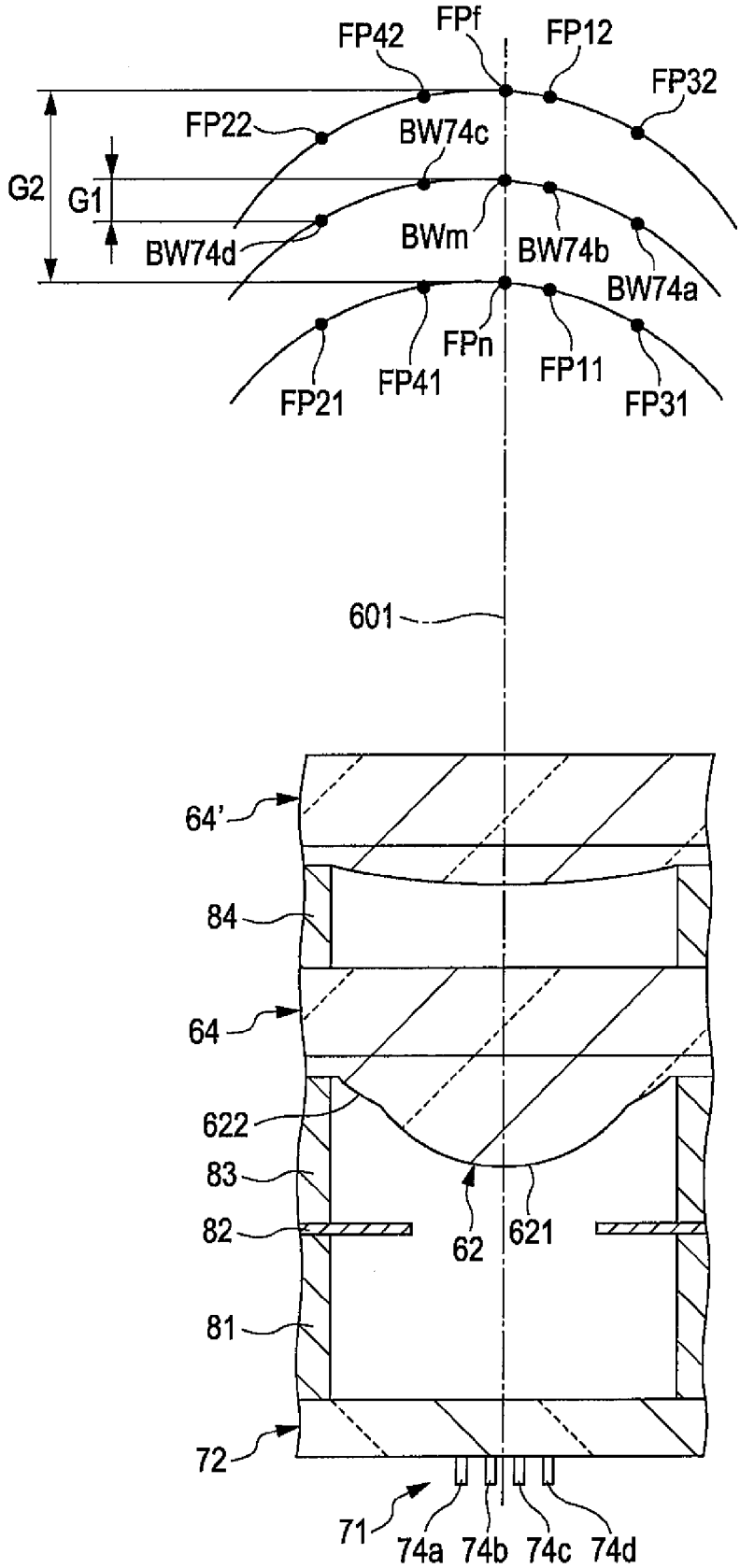
FIG. 11 is a view showing an imaging point of the optical system which is included in the line head shown in FIG. 2.
Figure 12:
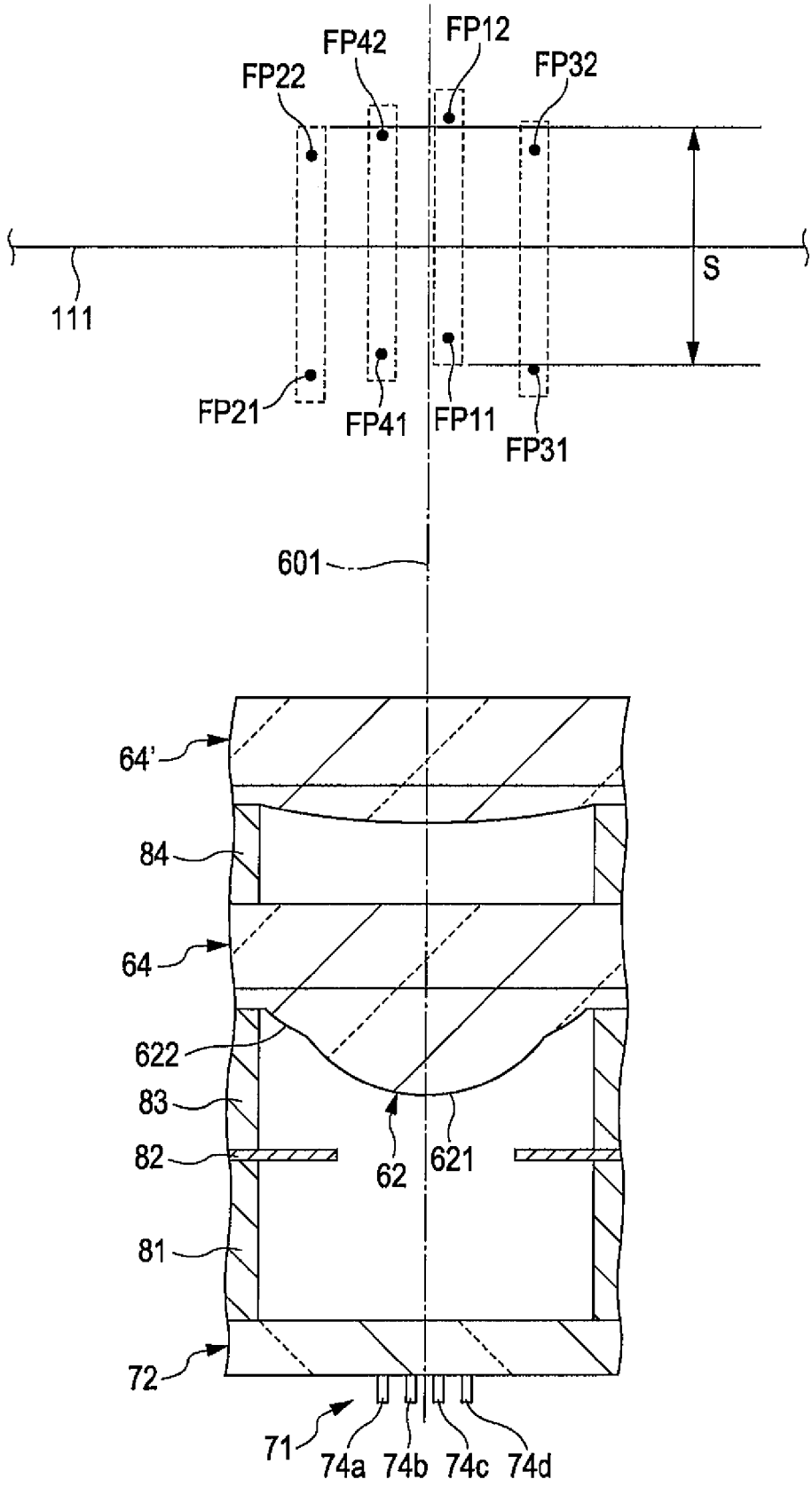
FIG. 12 is a view showing a positional relation between the line head shown in FIG. 2 and a photoconductor drum which is provided in the image forming apparatus shown in FIG. 1.
Figure 17:
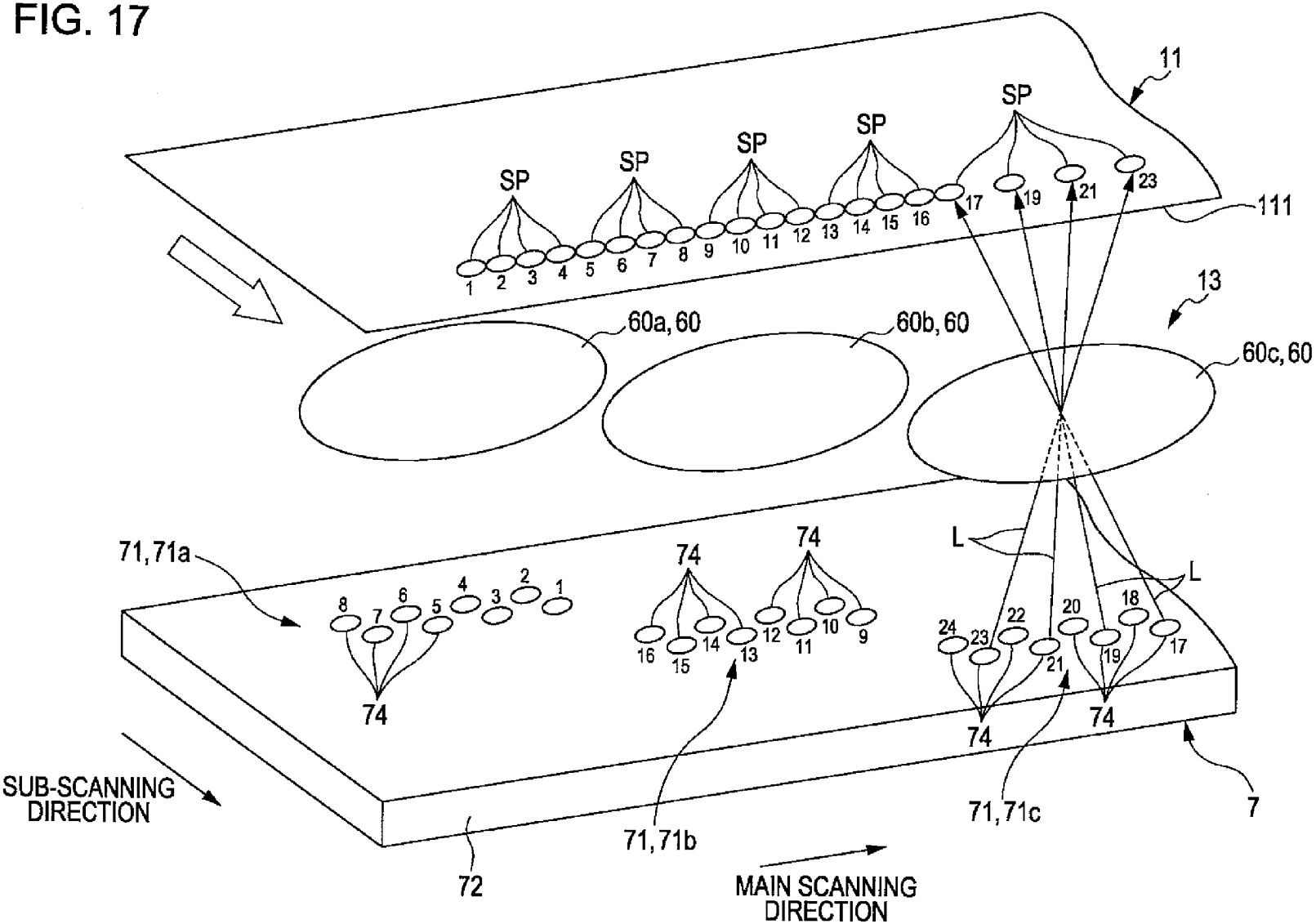
FIG. 17 is a schematic perspective view showing an operation state over time of the line head shown in FIG. 2.
Figure 18:
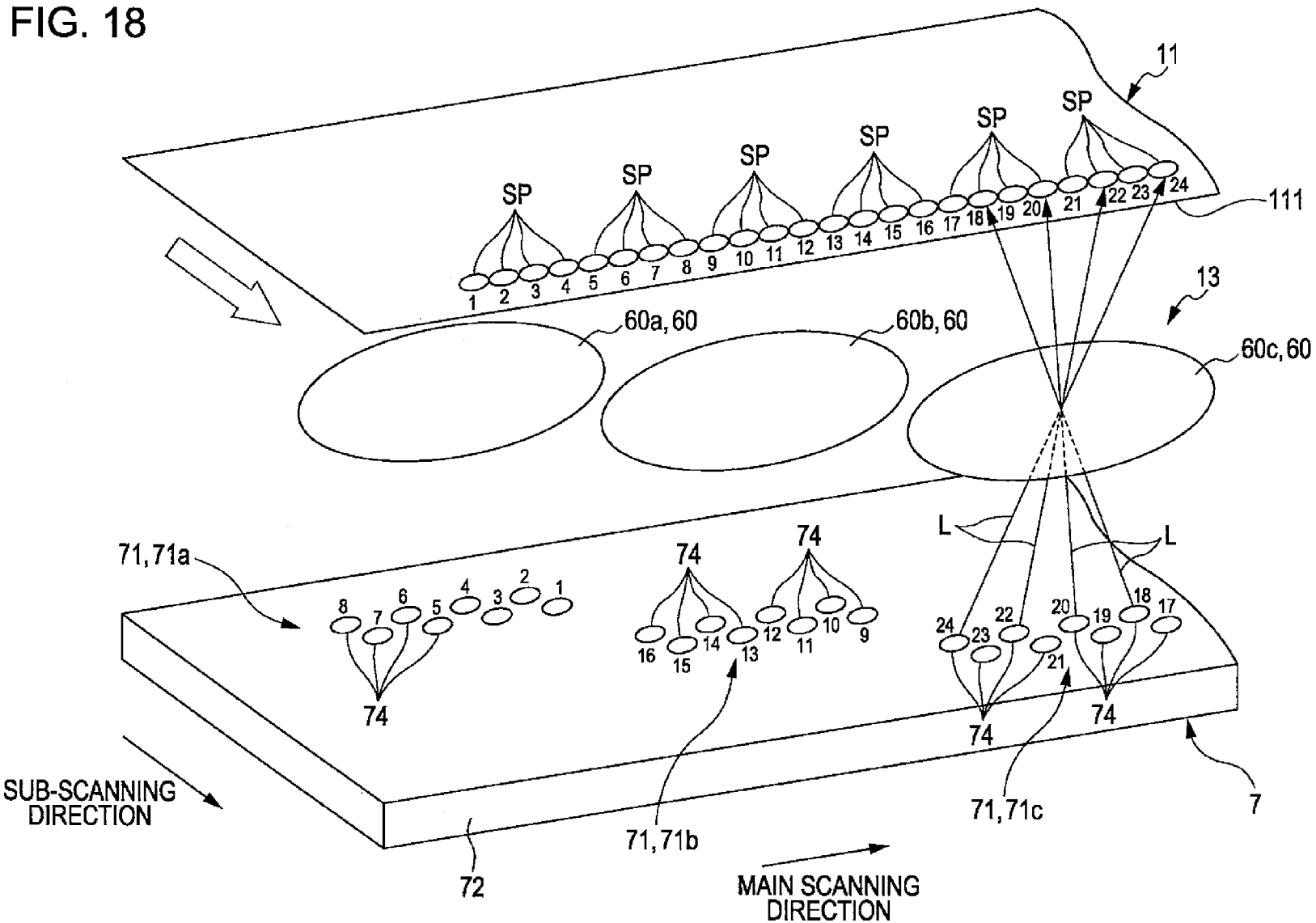
FIG. 18 is a schematic perspective view showing an operation state over time of the line head shown in FIG. 2.
Figure 19:
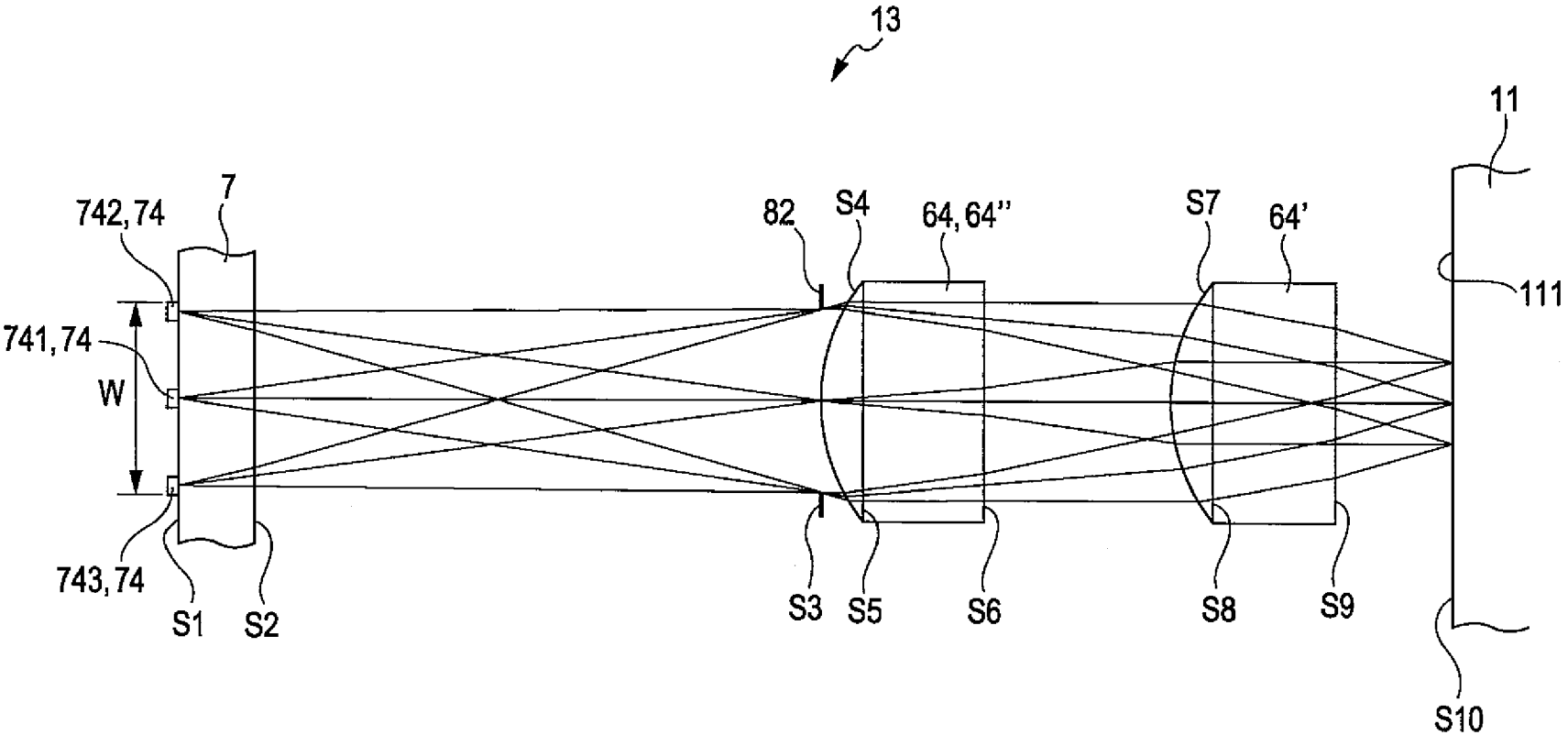
FIG. 19 is a view showing an example of the invention.
Figure 20A:
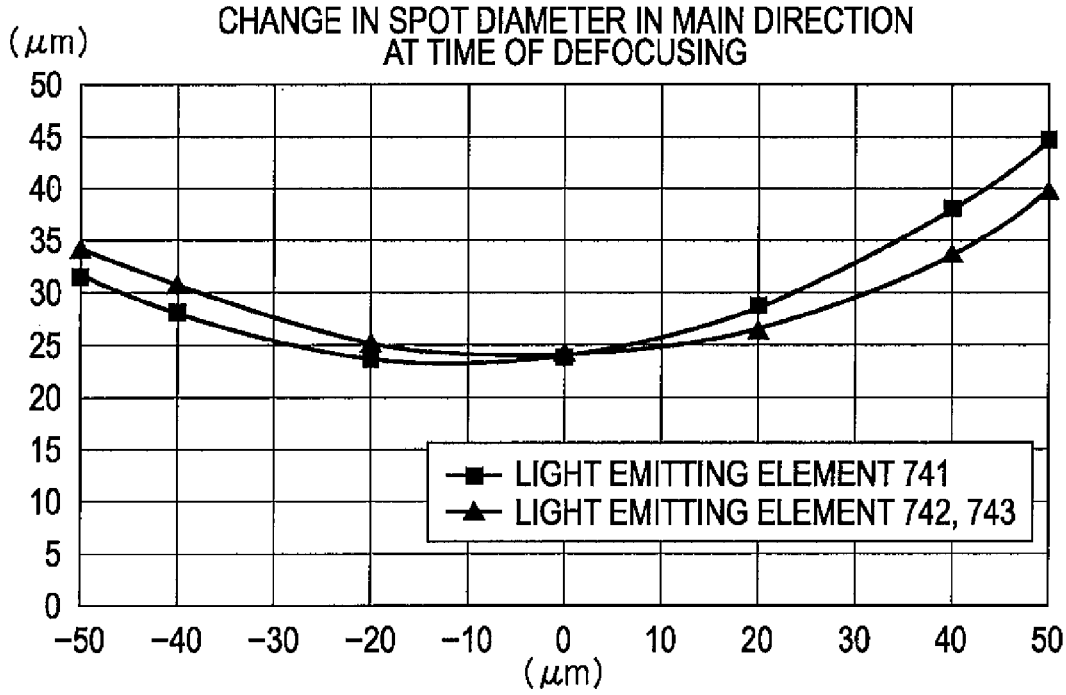
FIGS. 20A and 20B are graphs showing a change in a spot diameter in an optical axis direction with respect to the optical systems of an example and a comparative example.
Figure 20B:
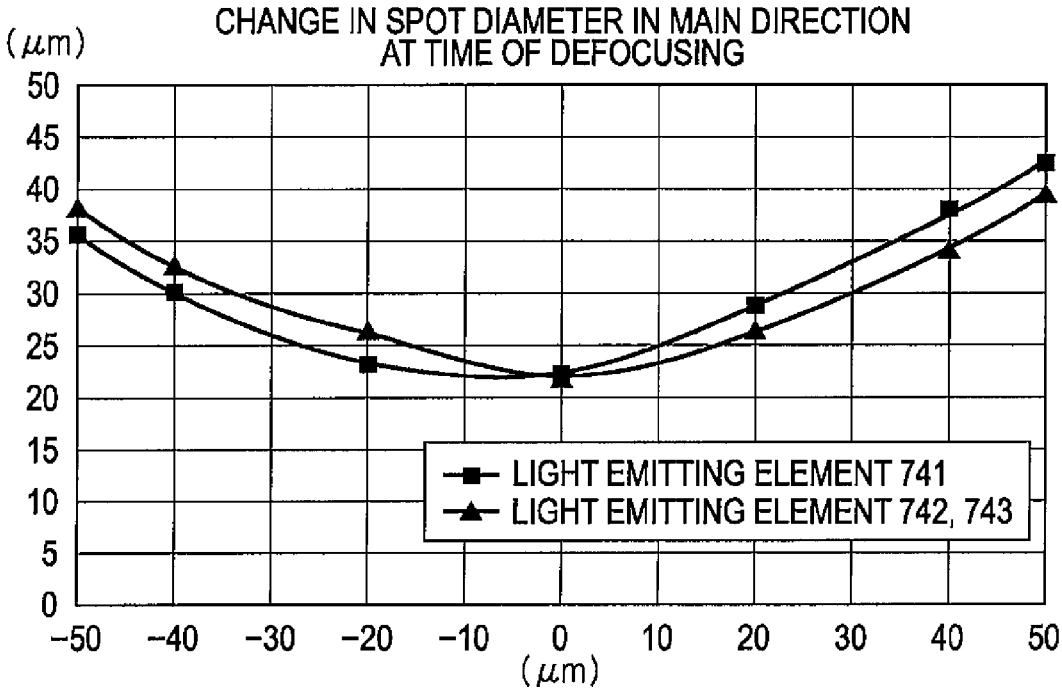

FIG. 1 is a schematic view showing the entire configuration of the image forming apparatus of the invention, FIG. 2 is a perspective view, partially in cut away, of the line head of the invention, which is provided in the image forming apparatus shown in FIG. 1, FIG. 3 is a cross-sectional view taken along line of FIG. 2, FIG. 4 is a plan view of the line head shown in FIG. 2, FIGS. 5A and 5B respectively are a plan view and a cross-sectional view of a lens which is included in the line head shown in FIG. 2, FIG. 6 is a view showing a focal point of the lens shown in FIGS. 5A and 5B, FIG. 7 is a view showing four light emitting elements which are adjacent to each other in a main scanning direction (a first direction), FIG. 8 is a view showing a chief ray of the light emitted from the light emitting elements which are included in the line head shown in FIG. 2, FIGS. 9, 10, and 11 are views showing an imaging point of an optical system which is included in the line head shown in FIG. 2, FIG. 12 is a view showing a positional relation between the line head shown in FIG. 2 and a photoconductor drum which is provided in the image forming apparatus shown in FIG. 1, FIGS. 13 to 18 are schematic perspective views showing an operation state over time of the line head shown in FIG. 2, FIG. 19 is a view showing an example of the invention, and FIGS. 20A and 20B are graphs showing a change in a spot diameter in an optical axis direction with respect to the optical systems of an example and a comparative example. In addition, hereinafter, for convenience in the explanation, the upper side in FIGS. 1 to 3 and FIGS. 13 to 18 is referred to as a "top" or an "upside" side, and the lower side is referred to as a "bottom" or a "downside" side.

Image Forming Apparatus

The image forming apparatus 1 shown in FIG. 1 is an electrophotographic printer which records an image on a recording medium P by a series of image forming processes including an electrification process, an exposure process, a developing process, a transfer process, and a fixing process. In this embodiment, the image forming apparatus 1 is a color printer which adopts a so-called tandem system.

Such an image forming apparatus 1 includes an image forming unit 10 for the electrification process, the exposure process, and the developing process, a transfer unit 20 for the transfer process, a fixing unit 30 for the fixing process, a transportation mechanism 40 for transporting the recording medium P such as paper, and a paper feed unit 50 which supplies the recording medium P to the transportation mechanism 40, as shown in FIG. 1.

The image forming unit 10 has four image forming stations, an image forming station 10Y which forms a yellow toner image, an image forming station 10M which forms a magenta toner image, an image forming station 10C which forms a cyan toner image, and an image forming station 10K which forms a black toner image.

Each of the image forming stations 10Y, 10M, 10C, and 10K has a photoconductor drum (photo conductor) 11 which supports an electrostatic latent image, and in the periphery (on the outer circumference side) of the photoconductor drum, an electrification unit 12, a line head (exposure unit) 13, a developing device 14, and a cleaning unit 15 are disposed. Since these devices constituting the respective image forming stations 10Y, 10M, 10C, and 10K are the same in configuration in the image forming stations, the devices of one image forming station will be explained below.

The shape of the whole of the photoconductor drum 11 is cylindrical. The outer circumferential surface (cylindrical surface) of the photoconductor drum 11 constitutes a light receiving surface 111 which receives the light L (emitted light) from the line head 13 (lens array 6). That is, on the outer circumferential surface of the photoconductor drum 11, a photosensitive layer (not shown) is formed. Also, the photoconductor drum 11 is rotatable in the direction of an arrow of FIG. 1 about its axis line. Further, the portions (both end portions) other than the light receiving surface 111 of the outer circumferential surface of the photoconductor drum 11 are non-photosensitive regions 112 which are not photosensitive to the light L.

The electrification unit 12 uniformly electrifies the light receiving surface 111 of the photoconductor drum 11 by corona electrical charging or the like.

The line head 13 receives image information from a host computer such as a personal computer (not shown) and in accordance with this, emits the light L toward the light receiving surface 111 of the photoconductor drum 11. On the other hand, the light receiving surface 111 of the photoconductor drum 11 is in a uniformly electrified state, so that a latent image is formed corresponding to the emission pattern of the light L. The configuration of the line head 13 will be described in detail later.

The developing device 14 has a storage portion (not shown) which stores toner, and supplies and imparts toner from the storage portion to the light receiving surface 111 of the photoconductor drum 11 which supports the electrostatic latent image, so that the latent image on the photoconductor drum 11 is visible as a toner image (becomes a visible image).

The cleaning unit 15 has a cleaning blade 151 made of rubber, which comes into contact with the light receiving surface 111 of the photoconductor drum 11, and toner remaining on the photoconductor drum 11 after primary transfer, which will be described later, is scraped off and removed by the cleaning blade 151.

The transfer unit 20 transfers as one unit the toner images of the respective colors formed on the photoconductor drums 11 of the image forming stations 10Y, 10M, 10C, and 10K as described above, to the recording medium P.

In each of the image forming stations 10Y, 10M, 10C, and 10K, during one rotation of the photoconductor drum 11, the electrification of the light receiving surface 111 of the photoconductor drum 11 by the electrification unit 12, the exposure of the light receiving surface 111 by the line head 13, the supply of toner to the light receiving surface 111 by the developing device 14, the primary transfer to an intermediate transfer belt 21 by the pressing of a primary transfer roller 22 which will be described later, and the cleaning of the light receiving surface 111 by the cleaning unit 15 are carried out in sequence.

The transfer unit 20 has the intermediate transfer belt 21 which has an endless belt shape, and the intermediate transfer belt 21 is mounted to pass over a plurality of (in the configuration shown in FIG. 1, four) primary transfer rollers 22, a driving roller 23, and a driven roller 24, and is rotationally driven by approximately the same peripheral velocity as that of the photoconductor drum 11 in the direction of an arrow of FIG. 1 by the rotation of the driving roller 23.

Each primary transfer roller 22 is disposed to face the corresponding photoconductor drum 11 with the intermediate transfer belt 21 interposed therebetween, and transfers (primarily transfers) the toner image of a single color on the photoconductor drum 11 to the intermediate transfer belt 21. At the time of the primary transfer, the primary transfer roller 22 is applied with a primary transfer voltage (primary transfer bias) having the opposite polarity to the electrically-charged polarity of the toner.

On the intermediate transfer belt 21, the toner image of at least one color of yellow, magenta, cyan, and black is supported. For example, when forming a full color image, the toner images of four colors of yellow, magenta, cyan, and black are sequentially transferred in layers to the intermediate transfer belt 21, so that a full color toner image is formed as an intermediate transfer image.

Further, the transfer unit 20 has a secondary transfer roller 25 disposed to face the driving roller 23 with the intermediate transfer belt 21 interposed therebetween, and a cleaning unit 26 disposed to face the driven roller 24 with the intermediate transfer belt 21 interposed therebetween.

The secondary transfer roller 25 transfers (secondarily transfers) the toner image (intermediate transfer image) of a single color, a full color, or the like formed on the intermediate transfer belt 21 to the recording medium P such as paper, film, or cloth, which is supplied from the paper feed unit 50. At the time of the secondary transfer, the secondary transfer roller 25 is pressed against the intermediate transfer belt 21, and also is applied with a secondary transfer voltage (secondary transfer bias). At the time of the secondary transfer, the driving roller 23 also functions as a backup roller of the secondary transfer roller 25.

The cleaning unit 26 has a cleaning blade 261 made of rubber, which comes into contact with the surface of the intermediate transfer belt 21, and the toner remaining on the intermediate transfer belt 21 after the secondary transfer is scraped off and removed by the cleaning blade 261.

The fixing unit 30 has a fixing roller 301 and a pressurizing roller 302 which is brought into pressure-contact with the fixing roller 301, and is configured such that the recording medium P passes between the fixing roller 301 and the pressurizing roller 302. Also, a heater which heats the outer circumferential surface of the fixing roller is built into the fixing roller 301 and can heat and pressurize the passing recording medium P. By using the fixing unit 30 of such a configuration, the recording medium P which has been subjected to the secondary transfer of the toner image is heated and pressed, so that the toner image is fused and bonded to the recording medium P, thereby being fixed as a permanent image.

The transportation mechanism 40 has a register roller pair 41 which transports the recording medium P to a secondary transfer portion between the above-mentioned secondary transfer roller 25 and the intermediate transfer belt 21 while measuring paper feed timing, and transportation roller pairs 42, 43, and 44 which nip and transport the recording medium P on which the fixing treatment at the fixing unit 30 has been completed.

In the case of carrying out image formation only on one side face of the recording medium P, the transportation mechanism 40 nips and transports the recording medium P with one side face subjected to the fixing treatment by the fixing unit 30 by using the transportation roller pair 42 and discharges it out of the image forming apparatus 1. Also, in the case of forming images on both faces of the recording medium P, once the recording medium P with one side face subjected to the fixing treatment by the fixing unit 30 has been nipped by the transportation roller pair 42, the transportation roller pair 42 is driven in reverse, and also the transportation roller pairs 43 and 44 are driven, so that the recording medium P is inverted from a front side to a back side and returned to the register roller pair 41, and then an image is formed on the other side face of the recording medium P by the same operation as that described above.

The paper feed unit 50 has a paper feed cassette 51 which contains the unused recording mediums P, and a pick-up roller 52 which feeds one by one the recording mediums P from the paper feed cassette 51 toward the register roller pair 41.

Line Head

Here, the line head 13 is described in detail. In addition, hereinafter, for convenience in the explanation, the longitudinal direction of the elongated line head 13 (a first lens array 6 and a second lens array 6' which will be described later) is referred to as a "main scanning direction", and the widthwise direction is referred to as a "sub-scanning direction".

As shown in FIG. 3, the line head 13 is disposed below the photoconductor drum 11 to face the light receiving surface 111 of the photoconductor drum 11. Also, the line head 13 is disposed such that the main scanning direction thereof is parallel to a rotary shaft of the photoconductor drum 11.

In the line head 13, the second lens array 6', a spacer 84, the first lens array 6, a spacer 83, a diaphragm 82, a light shielding member 81, and a light emitting element array 7 are disposed in this order from the photoconductor drum 11 side, and these members are housed in a casing 9.

In the line head 13, a configuration is made such that the light L emitted from the light emitting element array 7 is narrowed through the diaphragm 82, and then passes through the first lens array 6 and the second lens array 6', thereby being condensed on the light receiving surface 111 of the photoconductor drum 11.

As shown in FIGS. 2 to 4, the first lens array 6 is constituted of a plate-like body having an elongated outer shape. Also, a plurality of convexly-curved surfaces (lens faces) 62 are formed in the face (the incidence face to which the light L is incident) of the first lens array 6 on the light emitting element array 7 side. On the other hand, the face (exit face from which the light L exits) of the first lens array 6 on the photo conductor 11 side is constituted of a flat surface.

That is, in the first lens array 6, a plurality of lenses 64, each which is a plano-convex lens having the convexly-curved surface 62 on the face side to which the light L is incident and the flat surface on the face side from which the light L exits, are disposed. The portion (mainly, the portion in the periphery of each lens 64) other than on each lens 64 of the first lens array 6 constitutes a lens supporting portion 65 which supports each lens 64.

Each lens 64 is a multiple-focus lens having a plurality of focal points, as described later, and the configuration of the lens 64 will be described in detail later.

As shown in FIG. 4, the lenses 64 are disposed in a plurality of columns in the main scanning direction, and also in a plurality of rows in the sub-scanning direction which is perpendicular to each of the main scanning direction and the optical axis direction of the lens 64. More specifically, a plurality of lenses 64 are disposed in a matrix form of 3 rows by n columns (n is an integer of 2 or more). In addition, hereinafter, the lens 64 which is centrally positioned, among three lenses 64 belonging to one column (lens column) is referred to as a "lens 64*b*", the lens 64 which is positioned on the left in FIG. 3 (the upper side in FIG. 4) with respect to the centrally-positioned lens 64 is referred to as a "lens 64*a*", and the lens 64 which positioned on the right in FIG. 3 (the lower side in FIG. 4) is referred to as a "lens 64*c*".

In this embodiment, the line head 13 is installed in the image forming apparatus such that the lens 64*b* of the closest position to the center side of the sub-scanning direction, among a plurality of lenses 64 (64*a* to 64*c*) belonging to one column, is at the closest position to the light receiving surface 111 of the photoconductor drum 11. Therefore, the setting of the optical characteristic of an optical system 60, which will be described later, becomes easier.

Further, as shown in FIG. 4, in each lens column, the lenses 64*a* to 64*c* are disposed out of alignment in order by equal distances in the main scanning direction (in the right direction in FIG. 4). That is, in each lens column, the line connecting the lens centers of the lenses 64*a* to 64*c* is inclined at a given angle with respect to the main scanning direction and the sub-scanning direction.

When viewed in the cross-section shown in FIG. 3, in three lenses 64, namely, the lenses 64*a* to 64*c*, which belong to one lens column, the lenses 64*a* and 64*c* are disposed such that their optical axes are symmetrical with the optical axis of the lens 64*b* interposed therebetween. Also, the lenses 64*a* to 64*c* are disposed such that their optical axes are parallel to each other.

As shown in FIG. 3, on the light L exit side of the first lens array 6, the second lens array 6' is disposed with the spacer 84 interposed therebetween. The second lens array 6' has approximately the same configuration as the first lens array 6. That is, on the face on the first lens array 6 side of the second lens array 6', a plurality of convexly-curved surfaces (lens faces) 62' are formed, and the face on the photo conductor 11 side of the second lens array 6' is constituted of a flat surface.

Therefore, in the second lens array 6', it can be said that a plurality of lenses 64', each which is a plano-convex lens having the convexly-curved surface 62' on the face side to which the light L is incident and the flat surface on the face side from which the light L exits, are disposed. However, each lens 64' is a single focus lens having a single focal point, unlike the lens 64.

A plurality of lenses 64' are disposed in a matrix form of 3 rows by n columns (n is an integer of 2 or more) to correspond to and be spaced from a plurality of lenses 64 described above. That is, a plurality of lenses 64' are disposed in a matrix form as shown in FIG. 4. Also, the lenses 64' are disposed such that one lens 64' faces one lens 64 and the optical axis thereof is coincident with the optical axis of the opposite lens 64.

Antifouling treatment may also be carried out on the upper surface (the flat surface exposed outside the line head 13) of the second lens array 6'. As the antifouling treatment, treatment which prevents or suppresses a pollutant from becoming attached to an upper surface, and treatment which enables the easy removal of a pollutant even if the pollutant has become attached to the upper surface can be given as examples. As such antifouling treatment, a method which coats a fluorine-containing silane compound on an upper surface, for example, by a dipping method can be given as an example (for example, refers to JP-A-2005-3817).

Further, scratch proofing treatment may also be carried out on the upper surface of the second lens array 6'. As the scratch proofing treatment, a method which forms a layer containing $C_6H_{14}$ and $C_2F_6$ as its main component on the upper surface by a vapor-phase film-formation method such as a high-frequency plasma CVD method can be given as an example (for example, refers to JP-A-2006-133420).

Also, when the antifouling treatment or the scratch proofing treatment is carried out on the upper surface of the second lens array 6', because the upper surface is a flat surface, such an operation can be easily performed. Also, because the upper surface is a flat surface, a layer which is formed by the antifouling treatment or the scratch proofing treatment can be uniformly formed on the upper surface.

A constituent material of each of the lenses 64 and 64' is not particularly limited provided that it is a material which can express the optical characteristic as described above, but, for example, a resin material and/or a glass material can be suitably used.

As the resin material, various resin materials can be used, and, for example, liquid crystal polymer such as polyamide, thermoplastic polyimide, polyamide-imide, or aromatic polyester, polyolefin such as polyphenylene oxide, polyphenylene sulfide, or polyethylene, polyester such as modified polyolefin, polycarbonate, acryl (methacryl), polymethylmethacrylate, polyethylene terephthalate, or polybutylene terephthalate, thermoplastic resin such as polyether, polyether ether ketone, polyetherimide, or polyacetal, thermosetting resin such as epoxy resin, phenol resin, urea resin, melamine resin, unsaturated polyester resin, or polyimide resin, light curing resin, or the like can be give, and one kind or two or more kinds of them can be combined and used. In a case where thermosetting resin or light curing resin among such resin materials was used, the following effects can be obtained. That is, such a resin material is a material which has an advantage in that its refractive index is relatively high, and in addition, in which a thermal expansion coefficient is relatively low and expansion (deformation), alterations, or deterioration due to heat hardly occurs.

Also, as the glass material, various glass materials such as soda glass, crystalline glass, quartz glass, lead glass, potassium glass, borosilicate glass, and non-alkali glass can be given as examples. However, in a case where a supporting plate 72 constituting the light emitting element array 7, which will be described later, is constituted of a glass material, by using a glass material having approximately the same linear expansion coefficient as that of the glass material for the supporting plate, discrepancy in the relative position between the light emitting element and each lens due to temperature fluctuation can be prevented.

For example, in a case where the first and second lens arrays 6 and 6' are constituted by mixing the resin material and the glass material as described above, in a laminated structure in which a resin layer made of the resin material is formed on one side surface of a glass substrate made of the glass material, it is preferable to form each of the convexly-curved surfaces 62 and 62' on the face of the resin layer on the opposite side to the glass substrate. Also, the first and second lens arrays 6 and 6' can also be formed, for example, by providing a plurality of convex portions protruded in a convexly-curved surface shape, on one side surface of a flat plate-like member (substrate) in which each of an upper surface and a lower surface is formed of a flat surface. In this case, from the viewpoint of ease of manufacturing, guarantee of the rigidity of the first and second lens arrays 6 and 6', and the like, it is preferable to form the flat plate-like member from, for example, a glass material and form each convex portion from a resin material.

In addition, hereinafter, among three lenses 64' belonging to one column (lens column), the lens 64' which faces the lens 64*a* is referred to as a "lens 64*a*'", the lens 64' which faces the lens 64*b* is referred to as a "lens 64*b*'", and the lens 64' which faces the lens 64*c* is referred to as a "lens 64*c*'" (refers to FIG. 3).

Although the first lens arrays 6 having a plurality of lenses 64 and the second lens arrays 6' having a plurality of lenses 64' have been explained above, in the line head 13 of this embodiment, a set of corresponding lenses 64 and 64' constitute one optical system 60. In addition, hereinafter, for convenience in the explanation, the optical system 60 constituted of a set of lenses 64*a* and 64*a*' is referred to as a "optical system 60*a*", the optical system 60 constituted of a set of lenses 64*b* and 64*b*' is referred to as a "optical system 60*b*", and the optical system 60 constituted of a set of lenses 64*c* and 64*c*' is referred to as a "optical system 60*c*" (refers to FIG. 3).

As shown in FIG. 3, the light emitting element array 7 is installed on the light L incidence side of the first lens arrays 6 with the spacer 83, the diaphragm 82, and the light shielding member 81 interposed therebetween. The light emitting element array 7 has a plurality of light emitting element groups 71 and the supporting plate (head substrate) 72. The supporting plate 72 supports each light emitting element group 71 and is constituted of a plate-like body having an elongated outer shape. The supporting plate 72 is disposed in parallel to the first lens arrays 6.

Also, the supporting plate 72 is configured such that its length in the main scanning direction is longer than the length of the first lens arrays 6 in the main scanning direction. The length in the sub-scanning direction of the supporting plate 72 is also set to be longer than the length of the first lens arrays 6 in the sub-scanning direction.

A constituent material of the supporting plate 72 is not particularly limited, but, as in this embodiment, in a case where the light emitting element groups 71 are provided on the back face side of the supporting plate 72 (that is, in a case where a bottom emission type light emitting element is used as a light emitting element 74), it is appropriate to use a material having transparency, such as various glass materials or various plastics. Also, in a case where a top emission type light emitting element is used as the light emitting element 74, a constituent material of the supporting plate 72 is not limited to a material having transparency, but, for example, one or a combination of various metal materials such as aluminum and stainless steel, various glass materials, various plastics, or, the like can be used. In a case where the supporting plate 72 is constituted of various metal materials or various glass materials, heat generated by the light emission of each light emitting element 74 can be efficiently released through the supporting plate 72. Also, in a case where the supporting plate 72 is constituted of various plastics, reduction of the weight of the supporting plate 72 can be achieved.

Also, on the back face side of the supporting plate 72, a box-like retention portion 73 opened to the supporting plate 72 side is installed. In this retention portion 73, a plurality of light emitting element groups 71, conducting wires (not shown) electrically connected to the light emitting element groups 71 (each light emitting element 74), or circuits (not shown) for driving each light emitting element 74 are accommodated.

A plurality of light emitting element groups 71 are disposed in a matrix form of 3 rows by n columns (n is an integer of 2 or more) to correspond to and be spaced from a plurality of lenses 64 (optical systems 60) described above (for example, refers to FIG. 4). Also, each light emitting element group 71 is composed of a plurality of (in this embodiment, eight) light emitting elements 74.

As shown in FIG. 3, eight light emitting elements 74 constituting each light emitting element group 71 are disposed along the lower surface 721 of the supporting plate 72. The light L emitted from each light emitting element 74 is narrowed through the diaphragm 82, then passes through the optical system 60 (lenses 64 and 64'), and is condensed on the light receiving surface 111 of the photoconductor drum 11. Further, although will be described in detail later, the light L emitted from each light emitting element 74 exposes the light receiving surface 111, so that a spot SP is formed on the light receiving surface 111.

Also, as shown in FIG. 4, eight light emitting elements 74 are disposed so as to be spaced from each other in four columns in the main scanning direction and two rows in the sub-scanning direction. In this manner, eight light emitting elements 74 are disposed in a matrix form of 2 rows by 4 columns. Adjacent two light emitting elements 74 belonging to one column (light emitting element column) are disposed out of alignment in the main scanning direction. Also, in eight light emitting elements 74 disposed in a matrix form of 2 rows by 4 columns in this manner, a space between the light emitting elements 74 which are next to each other in the main scanning direction is complemented by one light emitting element 74 of the next row.

There is a limit in disposing, for example, eight light emitting elements 74 as closely as possible in one row. However, by disposing eight light emitting elements 74 with deviations as described above, it is possible to further increase the arrangement density of the light emitting elements 74. Therefore, when an image is recorded on the recording medium P, a recording density to the recording medium P can be further increased. Accordingly, the recording medium P can be obtained on which a high resolution, multi-gradation, and sharp image was supported.

Also, although in this embodiment, eight light emitting elements 74 belonging to one light emitting element group 71 are disposed in a matrix form of 2 rows by 4 columns, the arrangement is not limited to this, but, the light emitting elements may also be disposed in a matrix form, for example, of 4 rows by 2 columns.

As described above, a plurality of light emitting element groups 71 are disposed so as to be spaced from each other and in a matrix form of 3 rows by n columns. As shown in FIG. 4, three light emitting element groups 71 belonging to one column (light emitting element group column) are disposed out of alignment by equal distances in the main scanning direction (in the right direction in FIG. 4).

Also, in the light emitting element groups 71 disposed in a matrix form of 3 rows by n columns in this manner, spaces between adjacent light emitting element groups 71 are complemented in order by the light emitting element groups 71 of next row and the light emitting element groups 71 of the row after.

There is a limit in disposing, for example, a plurality of light emitting element groups 71 as closely as possible in one row. However, by disposing a plurality of light emitting element groups 71 with deviations as described above, it is possible to further increase the arrangement density of the light emitting element groups 71. Therefore, combined with the fact that eight light emitting elements 74 belonging to one light emitting element group 71 are disposed out of alignment, it is possible to further increase a recording density to the recording medium P when recording an image on the recording medium P. Accordingly, the recording medium P can be obtained on which an image which is higher in resolution, multi-gradation, excellent in color reproducibility, and further sharp was supported.

Further, each light emitting element 74 is an organic EL element (organic electroluminescence element) of bottom emission structure. Also, the light emitting element 74 is not limited to an element of bottom emission structure, but may also be an element of top emission structure. In this case, the supporting plate 72 does not require optical transparency as described above.

If each light emitting element 74 is an organic EL element, the distance (pitch) between the light emitting elements 74 can be set to be relatively small. Therefore, when an image is recorded on the recording medium P, a recording density to the recording medium P is relatively increased. Further, each light emitting element 74 can be formed with a highly precise size and position by using various film formation methods. Accordingly, the recording medium P can be obtained on which a further sharp image was supported.

In this embodiment, each light emitting element 74 is constituted to emit red light. Here, as a constituent material of a light emitting layer which emits red light, for example, (4-dicyanomethylene)-2-methyl-6-(paradimethylaminostyryl)-4H-pyran (DCM), Nile red, and the like can be given as examples. Also, each light emitting element 74 is not limited to an element constituted to emit red light, but may also be constituted to emit monochromatic light of another color, or white light. In this manner, in the organic EL element, the light L which the light emitting layer emits can be appropriately set to be monochromatic light of an arbitrary color according to a constituent material of the light emitting layer.

Further, in general, the spectral sensitivity characteristic of a photoconductor drum used in an electrophotographic process is set to have a peak in a range from red which is the luminescence wavelength of a semiconductor laser to near-infrared, and therefore, it is preferable to use a luminescence material for a red color, as described above.

As shown in FIG. 3, between the first lens array 6 and the light emitting element array 7, the light shielding member 81, the diaphragm 82, and the spacer 83 are disposed in this order from the light emitting element array 7 side.

The light shielding member 81 is a member for preventing cross-talk of the light L between adjacent light emitting element groups 71. The light shielding member 81 is constituted of a block body having an elongated outer shape. In the light shielding member 81 constituted of the block body, a plurality of through-holes 811 which pass through the light shielding member 81 in the up-and-down direction in FIG. 3 (in the thickness direction) are formed. Each through-hole 811 is disposed at a position corresponding to each lens 64 described above, and forms a portion of the optical path from the light emitting element group 71 to the lens 64 corresponding to the light emitting element group. Also, each through-hole 811 is of a circular shape in a plan view, and contains eight light emitting elements 74 of the light emitting element group 71 corresponding to the through-hole 811 in the inside thereof. Also, although each through-hole 811 is of a cylindrical shape in the configuration shown in FIG. 3, its shape is not limited to this, but it may also be of, for example, a circular truncated cone shape which is widened upward.

Also, such a light shielding member 81 also functions as a spacer for regulating the distance (gap) between the light emitting element array 7 and the diaphragm 82.

The diaphragm 82 is a member which makes only a portion of the light L emitted from each light emitting element group 71 reach the optical system 60. The diaphragm 82 is constituted of a plate member having an elongated outer shape. In the diaphragm 82 constituted of the plate member, a plurality of through-holes (openings) 821 which pass through the diaphragm in the up-and-down direction in FIG. 3 are formed.

Each through-hole 821 is formed at a position corresponding to the lens 64 (through-hole 811) described above. Also, each through-hole 821 is of a circular shape having a smaller diameter than that of the through-hole 811 in a plan view, and its center is approximately coincident with the center of the corresponding through-hole 811.

Due to the function of such a diaphragm 82, as described later, in each lens 64, a light passage region through which the light L emitted from the light emitting element group 71 corresponding to the lens passes, and a light non-passage region through which the light does not pass are formed.

The spacer 83 is a member for regulating the distance (gap) between the diaphragm 82 and the first lens array 6. The spacer 83 is constituted by forming a plurality of through-holes 831 which pass through in the up-and-down direction in FIG. 3 (in the thickness direction), in a block body having an elongated outer shape, similarly to the light shielding member 81 described above. Each through-hole 831 is disposed at a position corresponding to each lens 64 and forms an optical path from the light emitting element group 71 to the lens 64, along with the through-hole 811 corresponding to the through-hole 831.

Further, the light emitting element array 7 and the light shielding member 81, the light shielding member 81 and the diaphragm 82, the diaphragm 82 and the spacer 83, and the spacer 83 and the first lens array 6 are respectively fixed to each other, for example, by adhesion (adhesion by an adhesive agent or a solvent).

Also, it is preferable that in the light shielding member 81 and the spacer 83, at least the inner circumferential surfaces of the through-holes 811 and 831 be colored by a dark color such as black, dark blown, or dark blue. Also, it is preferable that in the diaphragm 82, at least the inner circumferential surface of the through-hole 821 and the lower surface portion exposed to the optical path be colored by a dark color such as black, dark blown, or dark blue. Therefore, when the light L passes through the through-holes 811, 831, and 821, the light can be prevented from reflecting from the inner circumferential surfaces.

The constituent materials of the light shielding member 81, the diaphragm 82, and the spacer 83 are not particularly limited, but, for example, the same constituent material as that of the supporting plate 72 can be used.

As shown in FIG. 3, the spacer 84 is disposed between the first lens array 6 and the second lens array 6'. The spacer 84 is a member for regulating a gap length which is the distance between the first lens array 6 and the second lens array 6'. Since the spacer 84 has the same configuration as the spacer 83 described above, the explanation thereof is omitted.

As shown in FIGS. 2 and 3, the first lens array 6, the second lens array 6', the light emitting element array 7, the light shielding member 81, the diaphragm 82, and the spacers 83 and 84 are collectively accommodated in the casing 9. The casing 9 has a frame member (casing main body) 91, a cover member (bottom cover) 92, and a plurality of clamp members 93 which fixes the cover member 92 to the frame member 91 (refers to FIG. 3).

As shown in FIG. 2, the whole of the frame member 91 has an elongated shape. Also, the frame member 91 is of a frame shape, and therefore, in the frame member 91, an inner cavity portion 911 opened to the upper and lower sides thereof is formed, as shown in FIG. 3. The width of the inner cavity portion 911 is reduced stepwise from the downside to the upside in FIG. 3.

Into the inner cavity portion 911, the second lens array 6', the spacer 84, the first lens array 6, the spacer 83, the diaphragm 82, the light shielding member 81, and the light emitting element array 7 are fitted, and they are fixed to each other, for example, by an adhesive agent. Therefore, the second lens array 6', the spacer 84, the first lens array 6, the spacer 83, the diaphragm 82, the light shielding member 81, and the light emitting element array 7 are collectively held in the frame member 91, so that the second lens array 6', the spacer 84, the first lens array 6, the spacer 83, the diaphragm 82, the light shielding member 81, and the light emitting element array 7 are positioned in the main scanning direction and the sub-scanning direction.

Here, an upper surface 722 of the supporting plate 72 of the light emitting element array 7 abuts against (comes into contact with) a stepped portion 915 formed on the wall surface of the inner cavity portion 911, and the lower end surface of the light shielding member 81, respectively. Further, the cover member 92 is inserted into the inner cavity portion 911 from below.

The cover member 92 is constituted of an elongated member having at its upper portion a recessed portion 922 in which the retention portion 73 is inserted. The upper end surface of the cover member 92 grasps the edge portion of the supporting plate 72 of the light emitting element array 7 in tandem with the stepped portion 915 of the frame member 91.

Further, the cover member 92 is pushed upward by each clamp member 93, so that the cover member 92 is secured to the frame member 91. Also, by the cover member 92 pushed up, the positional relations in the main scanning direction, the sub-scanning direction, and the up-and-down direction in FIG. 3, among the second lens, array 6', the spacer 84, the first lens array 6, the spacer 83, the diaphragm 82, the light shielding member 81, and the light emitting element array 7 are fixed.

It is preferable that there be a plurality of the clamp member 93 at regular intervals along the main scanning direction. Therefore, the frame member 91 and the cover member 92 can be uniformly grasped along the main scanning direction by the clamp members 93.

The clamp member 93 is formed by bending and working a metal plate into an approximately U-shape in the cross-section shown in FIG. 3. Each of the both end portions of the clamp member 93 are formed with a claw portion 931 which is bent inward. Each claw portion 931 is engaged with a shoulder portion 916 of the frame member 91.

Also, at the intermediate portion of the clamp member 93, a curved portion 932 is formed which is curved upward into an arch shape. The top portion of the curved portion 932 is pressed against the lower surface of the cover member 92 in a state where each claw portion 931 is engaged with the shoulder portion 916, as described above. Therefore, the cover member 92 is pushed upward in a state where the curved portion 932 is elastically deformed.

Also, in a case where the clamp members 93 which keep the frame member 91 and the cover member 92 in an engaged state have been removed, the cover member 92 can be removed from the frame member 91. Therefore, the maintenance, such as exchange and repair, of the light emitting element array 7 can be carried out.

Also, the constituent materials of the frame member 91 and the cover member 92 are not particularly limited, but, for example, the same constituent material as that of the supporting plate 72 can be used. The constituent material of the clamp member 93 is not particularly limited, but, aluminum or stainless steel can be given as examples. Also, the clamp member 93 may also be made of a hard resin material.

Further, although not shown, spacers which protrude upward are provided at both end portions in the longitudinal direction of the frame member 91. The spacers are members for regulating the distance between the light receiving surface 111 of the photo conductor 11 and the first and second lens arrays 6 and 6'.

Optical System

Next, the optical system 60 which is included in the line head 13 is explained. As described above, in the line head 13, one optical system 60 is constituted by one lens 64 and one lens 64' facing the lens 64, and a plurality of optical systems 60 are disposed in a matrix form. In this embodiment, each optical system 60 is an optical system which is telecentric on a light exit side (the photo conductor 11 side). Also, in this embodiment, an optical axis 601 is perpendicular to the substrate surface of the light emitting element array 7 and passes the geometrical center of the light emitting element group 71.

The optical systems 60 thus configured have the same configuration. Therefore, hereinafter, for convenience in the explanation, one optical system 60 is explained as a representative, and with respect to the other optical systems 60, the explanation is omitted.

First, two lenses 64 and 64' constituting one optical system 60 are explained.

FIG. 5A is a plan view of the lens 64, and FIG. 5B is a cross-sectional view in the main scanning direction including the optical axis of the lens 64. As shown in these drawings, the lens 64 is of a circular shape in a plan view, and is rotationally symmetrical about the optical axis of the lens 64. Therefore, the lens 64 can express the same optical characteristic in any cross-section including the optical axis of the lens 64.

The convexly-curved surface (lens face) 62 of the lens 64 is constituted of a first region 621 of a circular shape, which is positioned at the center portion of the lens face 62, a second region 622 of an annular shape, which is positioned to surround the periphery (outer circumference) of the first region 621, and a third region 623 of an annular shape, which is positioned to surround the periphery of the second region 622.

These three regions 621 to 623 are formed concentrically (into concentric circle shapes) with the optical axis of the lens 64 as a center. The first and second regions 621 and 622 of these three regions 621 to 623 are the light passage regions through which the light L emitted from the light emitting element group 71 passes, and the third region 623 is the light non-passage region through which the light L does not pass. Therefore, the shape (in particular, the face shape) of the third region 623 is not particularly limited. Also, the third region 623 may also be omitted.

The face shapes of the first and second regions 621 and 622 are designed such that the focal distances are different from each other. Specifically, as shown in FIG. 6, the focal point FP621 of the light which passed through the first region 621, among the light L emitted from an infinite distance, is positioned closer to the lens 64 than the focal point FP622 of the light which passed through the second region 622. That is, the focal distance of the first region 621 is shorter than the focal distance of the second region 622.

Further, in the planar view of the lens 64, the area of the second region 622 is smaller than the area of the first region 621.

Such face shapes of the first and second regions 621 and 622 are aspheric and defined by different definition expressions from each other. Specifically, each of the first region 621 and the second region 622 is expressed by Formula (1) shown below, and the value of at least one of c, K, A, B, C, and Δ of Formula (1) is set to be different from each other with respect to the regions. That is, the first region 621 and the second region 622 are defined by different definition expressions, so that the lens 64 having a plurality of focal points FP621 and FP622 as described above can be designed precisely and simply.

[Formula 1]

$$\frac{cr^2}{1+\sqrt{1-(1+K)c^2r^2}}+Ar^4+Br^6+Cr^8+\Delta \tag{1}$$

In Formula (1), r is a distance from the optical axis of the lens 64, c is curvature on the optical axis, K is a conic constant, and each of A, B, C, and Δ is an aspheric coefficient.

In addition, hereinafter, as shown in FIGS. 5A and 5B, the difference between the inclination θ1 of the first region 621 and the inclination θ2 of the second region 622 at the boundary portion (boundary point P) between the first region 621 and the second region 622 in the main scanning direction cross-section including the optical axis of the lens 64 (the optical axis 601 of the optical system 60) is referred to as Δθ. That is, when in the main scanning direction cross-section including the optical axis 601, the inclination of a tangent line to the first region 621 to the main scanning direction at the boundary point P is θ1 and the inclination of a tangent line to the second region 622 to the main scanning direction at the boundary point P is θ2, (θ1−θ2) is Δθ.

FIG. 7 shows the main scanning direction cross-section including the optical, axis 601 of the optical system 60, and in this drawing, the chief rays of the light emitted from four light emitting elements 74 which are arranged at regular intervals in the main scanning direction (the first direction) are shown. Here, the term "chief ray" means light (light ray) which passes through the center O of the diaphragm 82 (through-hole 821), among the light emitted from each light emitting element. Therefore, the chief ray of the light emitted from each light emitting element is approximately coincident with a line segment which connects the light emitting element and the center O of the diaphragm 82.

In addition, hereinafter, four light emitting elements 74 arranged in the main scanning direction (the first direction) are referred to as a "light emitting element 74*a*", a "light emitting element 74*b*", a "light emitting element 74*c*", and a "light emitting element 74*d*" in order from the left in FIG. 7. That is, the light emitting element 74*a* and the light emitting element 74*b*, the light emitting element 74*b* and the light emitting element 74*c*, and the light emitting element 74*c* and the light emitting element 74*d* are respectively adjacent to each other in the main scanning direction. In this embodiment, the light emitting element 74*b* is positioned at the closest position to the optical axis 601 (the separation distance from the optical axis is shortest), next the light emitting element 74*c* is positioned closer to the optical axis 601, and the light emitting element 74*a* and the light emitting element 74*d* are positioned at the farther position from the optical axis 601.

As shown in FIG. 8, an angle that the chief ray. ML74*b* of the light emitted from the light emitting element (first light emitting element) 74*b* positioned at the closest position to the optical axis 601, among four light emitting elements 74*a* to 74*d*, makes with the chief ray ML74*c* of the light emitted from the light emitting element 74*c* (second light emitting element) which is adjacent to the light emitting element 74*b* and close to the optical axis next to the light emitting element 74*b* is indicated by ω.

As described above, each of the first region 621 and the second region 622 formed on the lens face 62 of the lens 64 is defined by Formula (1), and, the value of at least one of c, K, A, B, C, and Δ of Formula (1) is set to be different from each other with respect to the regions. Further, the values of c, K, A, B, C, and Δ of Formula (1) which prescribes the first region 621, and the values of c, K, A, B, C, and Δ of Formula (1) which prescribes the second region 622 are set such that the above-mentioned Δθ and ω satisfy the relationship of $0.5\omega<\Delta\theta$ (i.e., $0.5\omega(\theta 1-\theta 2)$). That is, the definition expression which prescribes the face shape of the first region 621 and the definition expression which prescribes the face shape of the second region 622 are determined to satisfy the relationship of $0.5\omega<\Delta\theta$.

Since the optical system 60 has the lens face 62 (lens 64) provided with the first and second regions 621 and 622 having such a relationship ($0.5\omega<\Delta\theta$), it is possible to make the relationship between G1 and G2, which are described later, become the relationship of G1<G2, as described later, and make the spot diameters of the spots SP arranged along the main scanning direction on the light receiving surface 111 of the photo conductor 11 uniform and approximately the same and desired size. As a result, a desired latent image can be formed on the light receiving surface 111.

Further, it is preferable that the relationship of $\Delta\theta>0.261$ be satisfied. Therefore, the above-mentioned effect becomes further remarkable.

In addition, although in this embodiment, an angle that the chief ray ML74*b* of the light emitted from the light emitting element 74*b* makes with the chief ray ML74*c* of the light emitted from the light emitting element 74*c* is taken as ω, ω is not particularly limited, provided that it is an angle formed by the chief rays of the light emitted from the light emitting elements which are adjacent to each other in the main scanning direction. For example, an angle that the chief ray ML74*a* of the light emitted from the light emitting element 74*a* makes with the chief ray ML74*b* of the light emitted from the light emitting element 74*b* which is adjacent to it may also be taken as ω, or an angle that the chief ray ML74*c* of the light emitted from the light emitting element 74*c* makes with the chief ray ML74*d* of the light emitted from the light emitting element 74*d* which is adjacent to it may also be taken as ω.

On the other hand, the lens 64' is a lens having one focal point. The lens face 62' of the lens 64' is a freely curved surface (xy polynomial expression surface).

Two lenses 64 and 64' constituting the optical system 60 have been described above.

Figure 9:
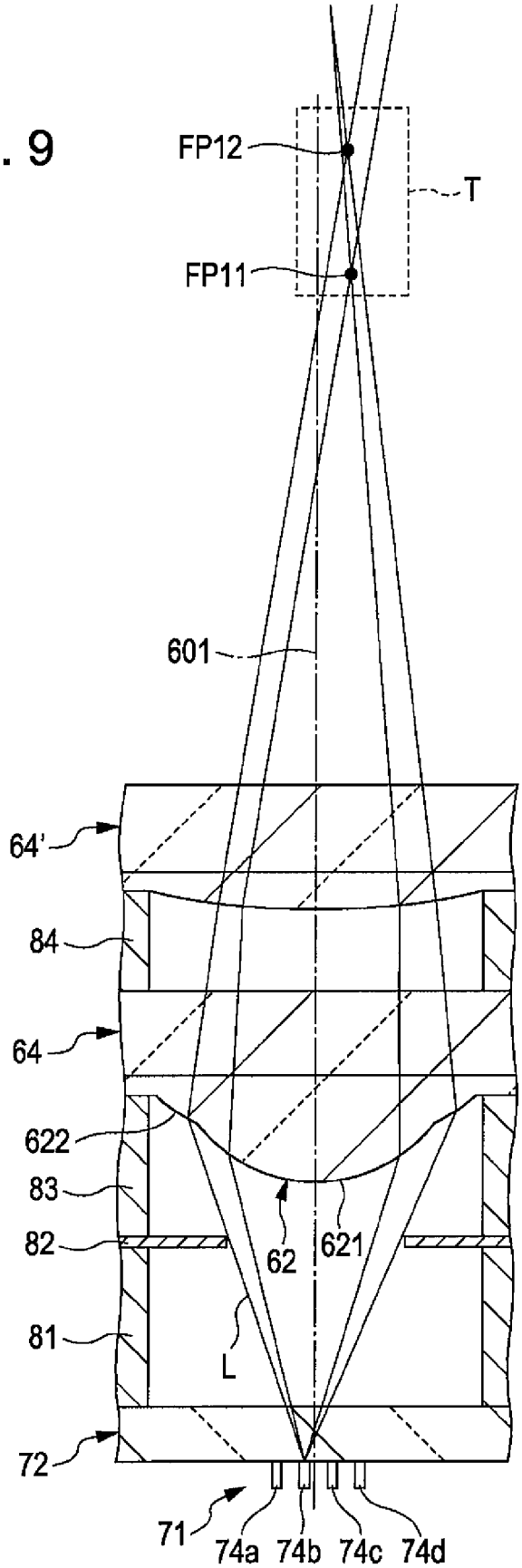
FIG. 9 is a view showing an imaging point of an optical system which is included in the line head shown in FIG. 2.

Next, how the light emitted from the light emitting element group 71 is condensed (imaged) by the optical system 60 is explained on the basis of FIGS. 9 and 10. FIGS. 9 and 10 are cross-sectional views in the main scanning direction including the optical axis 601 of the optical system 60.

First, the light emitted from the light emitting element 74*b* which is at the closest position to the optical axis 601 is explained.

As shown in FIG. 6, the lens 64 has two focal points. Accordingly, as shown in FIG. 9, the imaging point of the light L emitted from the light emitting element 74*b* and passed through the first region 621 of the lens 64 is FP11, and the imaging point of the light L passed through the second region 622 is FP12. The two imaging points FP11 and FP12 are arranged so as to be spaced from each other in the optical axis direction of the optical system 60 (hereinafter, also simply referred to as an "optical axis direction"). Also, the imaging point FP11 is positioned closer to the optical system 60 than the imaging point FP12. That is, with the intersection point of the final surface of the optical system 60 with the optical axis 601 as a reference position, when the optical axis direction distance from the reference position to the imaging point FP11 is L11 and the optical axis direction distance from the reference position to the imaging point FP12 is L12, the relationship of L11<L12 is satisfied.

If the optical system 60 is used in which two imaging points FP11 and FP 12 are out of alignment in the optical axis direction in this manner, with respect to the light L emitted from the light emitting element 74*b* and passed through the optical system 60, a region (hereinafter, also simply referred to as a "small spot diameter region T") having a spot diameter which is relatively small and does not so much change can be formed over a wide area along the optical axis direction. Here, since the "small spot diameter region T" as referred to in this specification also varies according to a desired image quality (resolution) and the like, it is not particularly limited, but, for example, it can also be defined as a region having a spot diameter of 35 μm or less, or a region having a spot diameter within 1.5 times of a minimum spot diameter.

The separation distance (displacement amount in the optical axis direction) between the imaging point FP11 and the imaging point FP12 is not particularly limited, but preferably is in the range of 0.02 mm to 0.05 mm, and more preferably in the range 0.03 mm to 0.04 mm. Therefore, the small spot diameter region T can be formed over a wide area along the optical axis direction.

As described above, the first region 621 and the second region 622 have approximately the same area as each other. Therefore, the amount of the light which passes through the first region 621, among the light L emitted from the light emitting element 74*b*, becomes approximately the same as the amount of the light which passes through the second region 622. As a result, the effect of expanding the small spot diameter region T is increased.

In addition, hereinafter, a point having a smallest spot diameter in the small spot diameter region T is referred to as a "beam waist". Also, in a case where the point (point having a smallest spot diameter) extends in the optical axis direction of the optical system 60, an intermediate point thereof is called a "beam waist". In a case where there is a plurality of points, the closest point to the optical system 60 is called a "beam waist". Such definition of the "beam waist" is also similarly applied to the light emitted from the other light emitting elements (for example, light emitting elements 74*a*, 74*c*, and 74*d*).

Next, the light L emitted from the light emitting element (second light emitting element) 74*d* which is at the most distant position from the optical axis 601 is explained.

The light L emitted from the light emitting element 74*d* and passed through the optical system 60 is also similar to the case of the light emitting element 74*b* described above. That is, as shown in FIG. 10, the imaging point of the light L emitted from the light emitting element 74*d* and passed through the first region 621 of the lens 64 is FP21, and the imaging point of the light L passed through the second region 622 is FP22. The two imaging points FP21 and FP22 are out of alignment in the optical axis direction, and the imaging point FP21 is positioned closer to the optical system 60 than the imaging point FP22.

The light L which is emitted from the other light emitting elements 74*a* and 74*c* is also similar to the light L which is emitted from the above-described light emitting elements 74*b* and 74*d*. Therefore, with respect to the light L emitted from the light emitting elements 74*a* and 74*c* and passed through the optical system 60, the explanation thereof is omitted. Further, hereinafter, the imaging point of the light L emitted from the light emitting element 74*a* and passed through the first region 621 of the lens 64 is referred to as "FP31", and the imaging point of the light L passed through the second region 622 is referred to as "FP32". Also, the imaging point of the light L emitted from the light emitting element 74*c* and passed through the first region 621 of the lens 64 is referred to as "FP41", and the imaging point of the light L passed through the second region 622 is referred to as "FP42".

FIG. 11 is a view showing the imaging points (imaging points FP11 to FP42) and the beam waists BW74*a* to BW74*d* of the light L emitted from the respective light emitting elements 74*a* to 74*d*. In addition, BW74*a* in FIG. 11 is the beam waist of the light L emitted from the light emitting element 74*a*, BW74*b* is the beam waist of the light L emitted from the light emitting element 74*b*, BW74*c* is the beam waist of the light L emitted from the light emitting element 74*c*, and BW74*d* is the beam waist of the light L emitted from the light emitting element 74*d*.

Also, the intersection point of a curved line connecting the imaging points FP12, FP22, FP32, and FP42 (the imaging points of the light L passed through the second region 622) with the optical axis 601 is referred to as an imaging point FPf, the intersection point of a curved line connecting the imaging points FP11, FP21, FP31, and FP41 (the imaging points of the light L passed through the first region 621) with the optical axis 601 is referred to as an imaging point FPn, and the intersection point of a curved line connecting the beam waists BW74*a* to BW74*d* with the optical axis 601 is referred to as BWm.

Four beam waists BW74*a* to BW74*d* are out of alignment in the optical axis direction (second direction). Among the four beam waists BW74*a* to BW74*d*, the beam waist positioned farthest from the optical system 60 in the optical axis direction is the beam waist BW74*b* of the light emitted from the light emitting element 74*b* positioned closest to the optical axis 601, among the four light emitting elements 74*a* to 74*d*, and the beam waist positioned closest to the optical system 60 is the beam waist BW74*d* of the light emitted from the light emitting element 74*d* positioned farthest from the optical axis 601, among the four light emitting elements 74*a* to 74*d*.

Here, since the lens face 62 of the lens 64 is designed to satisfy the relationship of $0.5\omega<\Delta\theta$, as described above, when the separation distance (displacement amount) in the optical axis direction (second direction) between the beam waist BW74*d* positioned farthest from the optical axis 601 and the beam waist BWm on the optical axis 601 is G1 and the separation distance between the imaging point FPn and the imaging point FPf is G2, the optical system 60 satisfies the relationship of G1<G2.

According to the line head 13 provided with the optical system 60 which satisfies such a relationship (G1<G2), even if the separation distance between the line head and the light receiving surface 111 of the photoconductor drum 11 is deviated from a predetermined value, or the separation distance between the line head and the light receiving surface 111 is changed according to the rotation of the photo conductor 11, or the like, the spots SP which have an almost uniform and desired size can be formed on the light receiving surface 111 in the main scanning direction. That is, it is possible to make the spot diameters of the spots SP arranged in the main scanning direction on the light receiving surface 111 uniform and approximately the same and desired size. As a result, a desired latent image can be formed on the light receiving surface 111.

Hereinafter, more concrete explanation is made. As shown in FIG. 12, the line head 13 is disposed such that the light receiving surface 111 is positioned in a region S in which in the optical axis direction of the optical system 60, all of a small spot diameter region Ta of the light L emitted from the light emitting element 74*a*, a small spot diameter region Tb of the light L emitted from the light emitting element 74*b*, a small spot diameter region Tc of the light L emitted from the light emitting element 74*c*, and a small spot diameter region Td of the light L emitted from the light emitting element 74*d* exist. At this time, as shown in FIG. 12, it is preferable to install the line head 13 such that the light receiving surface 111 is positioned in approximately the middle in the optical axis direction of the region S.

If the line head 13 is installed in this manner, the spot diameter of the spot SP formed by the light L emitted from the light emitting element 74*a*, the spot diameter of the spot SP formed by the light L emitted from the light emitting element 74*b*, the spot diameter of the spot SP formed by the light L emitted from the light emitting element 74*c*, and the spot diameter of the spot SP formed by the light L emitted from the light emitting element 74*d* become approximately the same on the light receiving surface 111. That is, it is possible to make the spot diameters of a plurality of spots SP arranged in the main scanning direction (the rotary shaft direction of the photoconductor drum 11) approximately the same. Further, it is possible to make all these spot diameters uniform and a desired size. Therefore, it is possible to make the spot diameters of all spots SP which are formed on the light receiving surface 111 approximately the same, so that a desired latent image without distortion, unevenness, blurring, or the like can be formed on the light receiving surface 111.

Further, even if at the time of the installation (attachment) of the line head 13, the installation position is slightly deviated from a predetermined position in the optical axis direction (including that the line head 13 is displaced away from or toward the light receiving surface 111), it is possible to position the light receiving surface 111 within the region S. As described above, since within the small spot diameter region T, the spot diameter is almost constant in the optical axis direction, even in a case where the deviation in the optical axis direction as described above has occurred, it is possible to make the spot diameter of the spot SP which is formed on the light receiving surface 111 approximately the same as the spot diameter of the spot SP which is formed on the light receiving surface 111 when the deviation does not occur. Therefore, a desired latent image can be formed on the light receiving surface 111, and also the installation of the line head 13 is simplified. Also, yield is improved.

Also, if the transverse cross-sectional shape of the photo conductor 11 is slightly distorted from an exact circle, or the rotary shaft of the photo conductor 11 is deviated from the center of the exact circle, the separation distance between the light receiving surface 111 and the line head 13 varies over time according to the rotation of the photo conductor 11. Even if the separation distance between the light receiving surface 111 and the line head 13 varies over time in this manner, if the line head 13 is installed as described above, it is possible continually to position the light receiving surface 111 within the region S. Therefore, with respect to all spots SP which are formed on the light receiving surface 111, it is possible to make the spot diameters approximately the same (keep them at a desired size), so that a desired latent image without distortion, unevenness, blurring, or the like can be formed on the light receiving surface 111.

Such an optical system 60 is constituted by the lens 64 having a plurality of focal points and the lens 64' having one focal point, and the lens 64 and the lens 64' are disposed in this order from the upstream side of the travelling direction of the light emitted from the light emitting element group 71. In this manner, by disposing the lens 64 at the closer position to the light emitting element group 71, it is possible to reduce the influence of the difference of the field angles of four light emitting elements 74*a* to 74*d* (an angle that the line segment connecting the light emitting element 74 and the center of the diaphragm 82 makes with the optical axis 601), and more surely to exert the effect as described above. Further, the lens 64 and the lens 64' may also be disposed in reverse.

Although the optical characteristic of the optical system 60 when viewed in the main scanning direction cross-section including the optical axis 601 of the optical system 60 has been described above, the optical system 60 has the same optical characteristic also with respect to another (arbitrary) cross-section including the optical axis 601 thereof. Therefore, the degree of freedom of the disposition of a plurality light emitting elements 74 constituting the light emitting element group 71 is increased, and accordingly, the degree of freedom of the design of the line head 13 is increased.

Further, in the latent image writing by the line head 13, it is important that the spot diameters in the main scanning direction rather than the sub-scanning direction in which a latent image supporting body surface which is the light receiving surface 111 travels are uniform, and when viewed in the main scanning direction cross-section, the above-mentioned optical characteristic is exerted, so that the effect can be obtained.

Next, one example of the operation of the line head 13, that is, the light emission timing of each light emitting element 74 is explained with reference to FIGS. 13 to 18. Further, since the operation of the respective light emitting element group columns is the same, the operation of the light emitting element group column (the light emitting element groups 71*a* to 71*c*) positioned in the first column is representatively explained below. Also, as described above, eight light emitting elements 74 belonging to the light emitting element groups 71*a* are numbered by number 1 to number 8. Eight light emitting elements 74 belonging to the light emitting element groups 71*b* are similarly numbered by number 9 to number 16. Eight light emitting elements 74 belonging to the light emitting element groups 71*c* are similarly numbered by number 17 to number 24. Also, in the following explanation, the respective numbers given to the light emitting elements 74 correspond to the respective numbers given to the spots (latent images) SP.

When the line head 13 operates, the photoconductor drum 11 performs the constant velocity rotation at a predetermined peripheral velocity.

Figure 13:
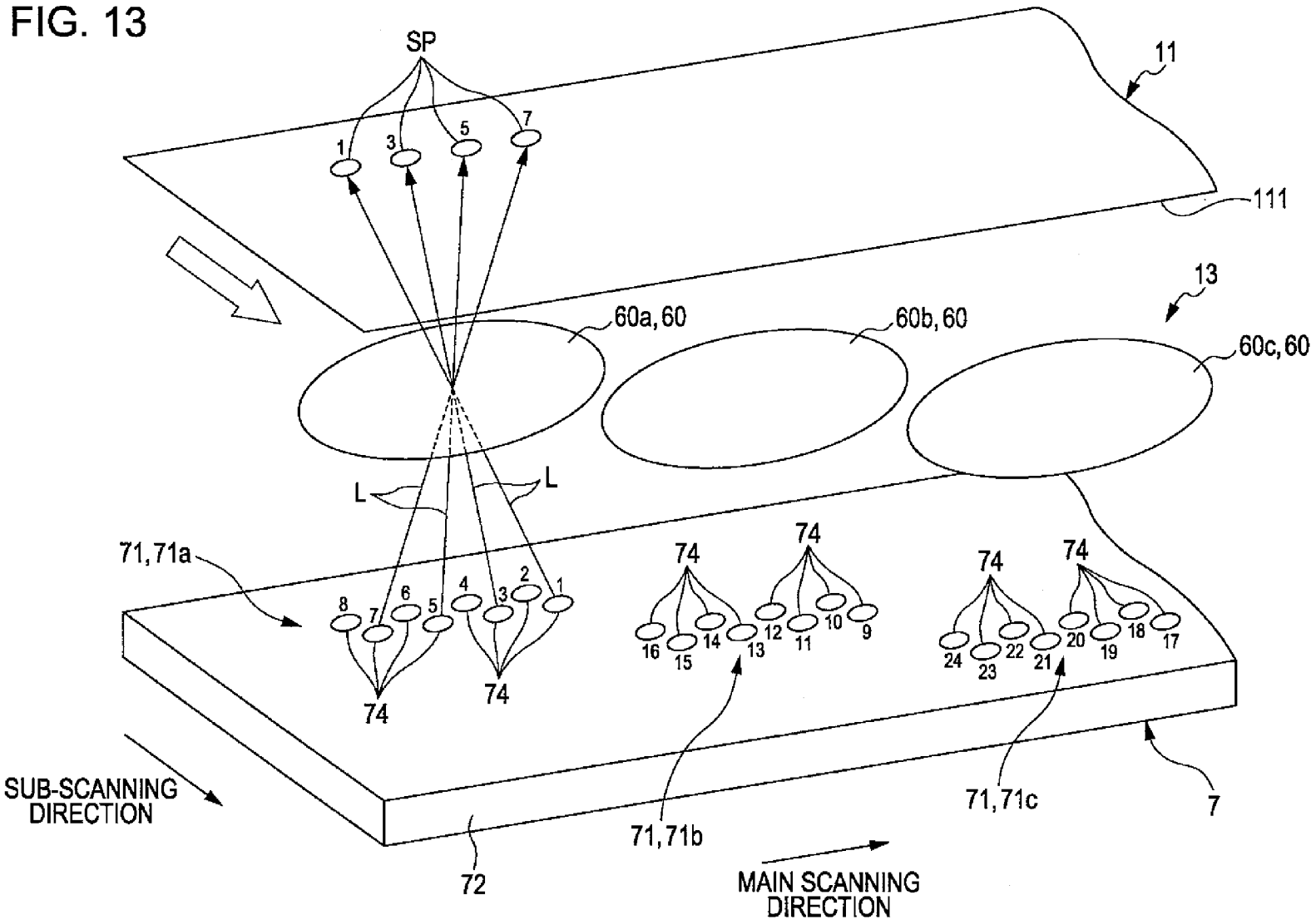
FIG. 13 is a schematic perspective view showing an operation state over time of the line head shown in FIG. 2.

First, as shown in FIG. 13, the number 1, 3, 5, and 7 light emitting elements 74 emit light at the same time and for a predetermined time (for an instant). By the light emission of these light emitting elements 74, four spots SP corresponding to the respective light emitting elements 74 are formed on the light receiving surface 111 of the photoconductor drum 11. Each spot SP has a minute area.

Each of four spots SP is formed at the inverted position with respect to each of the number 1, 3, 5, and 7 light emitting elements 74 through the lens 64*a*.

In other words, the number 1 spot SP corresponding to the number 1 light emitting element 74 positioned on the rightmost side in FIG. 13 is positioned on the leftmost side in FIG. 13. The number 3 spot SP is positioned adjacent to, but spaced from the number 1 spot SP rightward in the main scanning direction. The number 5 spot SP is positioned adjacent to, but spaced from the number 3 spot SP rightward in the main scanning direction. The number 7 spot SP is positioned adjacent to, but spaced from the number 5 spot SP rightward in the main scanning direction.

Figure 14:
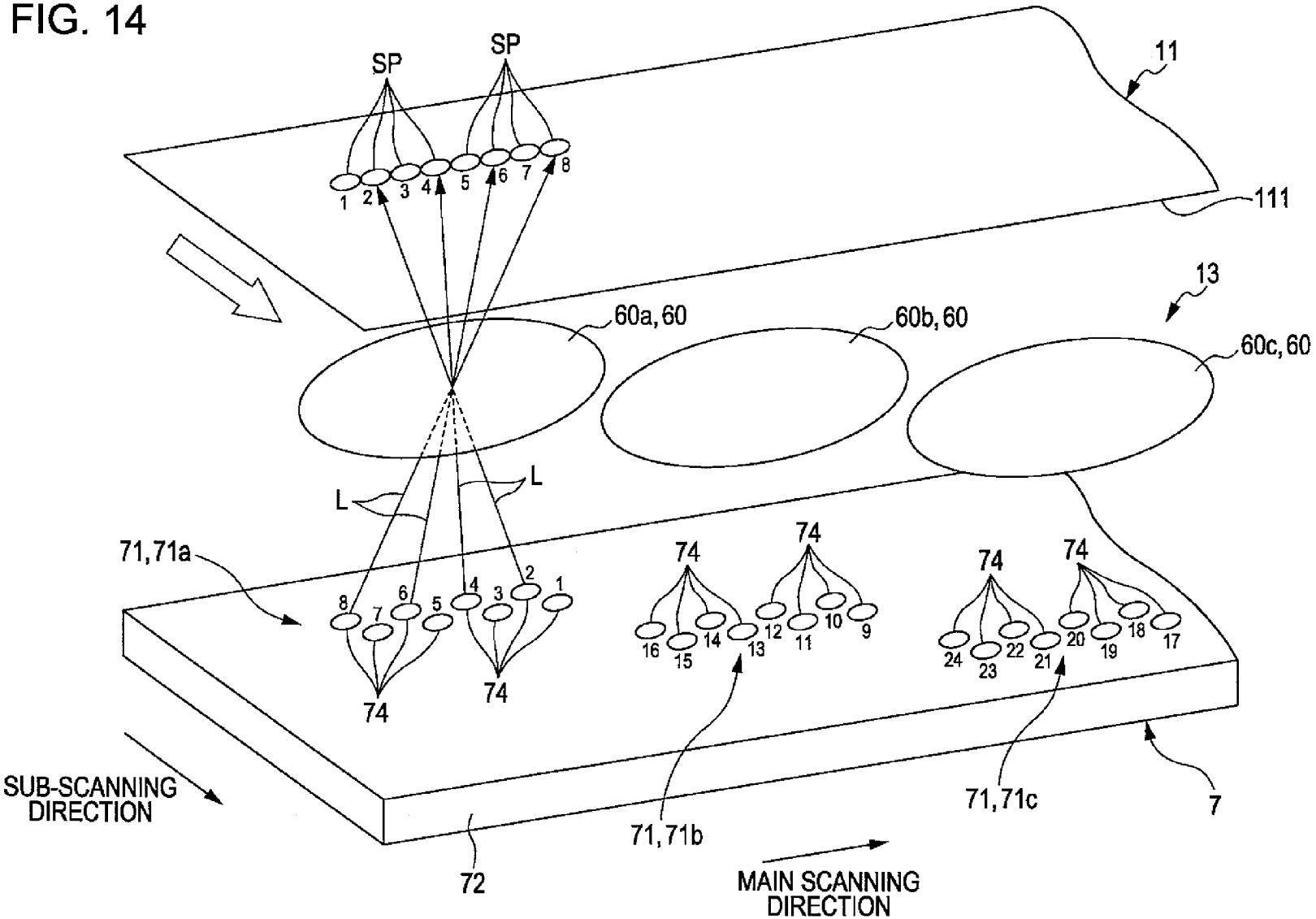
FIG. 14 is a schematic perspective view showing an operation state over time of the line head shown in FIG. 2.

Next, the number 2, 4, 6, and 8 light emitting elements 74 emit light at the same time and for a predetermined time (for an instant) in synchronization with (in conjunction with) the rotation of the photoconductor drum 11 (refers to FIG. 14). By the light emission of these light emitting elements 74, four spots SP corresponding to the respective light emitting elements 74 are formed on the light receiving surface 111 of the photoconductor drum 11.

At this time, since the above-mentioned number 1, 3, 5, and 7 spots SP have been moved according to the rotation of the photoconductor drum 11, these four spots SP of number 2, 4, 6, and 8 are respectively formed to fill up each space between the number 1, 3, 5, and 7 spots SP. Therefore, the number 1 to 8 spots SP are disposed in one straight line shape along the main scanning direction in order from the left in FIG. 14.

Figure 15:
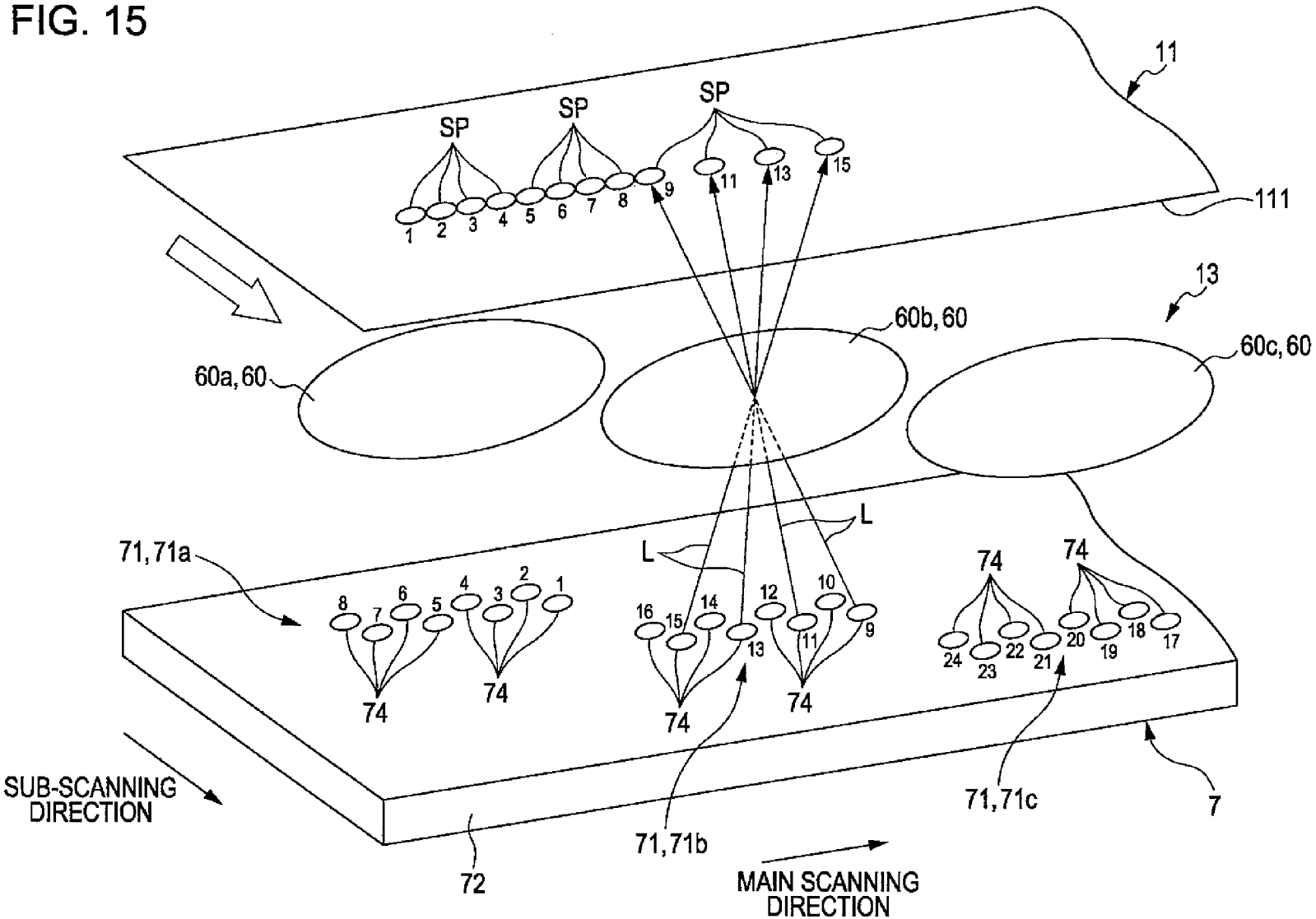
FIG. 15 is a schematic perspective view showing an operation state over time of the line head shown in FIG. 2.

Next, the number 9, 11, 13, and 15 light emitting elements 74 emit light at the same time and for a predetermined time (for an instant) in synchronization with the rotation of the photoconductor drum 11 (refers to FIG. 15). By the light emission of these light emitting elements 74, four spots SP corresponding to the respective light emitting elements 74 are further formed on the light receiving surface 111 of the photoconductor drum 11.

These four spots SP are formed on the right side of the number 8 spot SP in the main scanning direction. The number 9 spot SP is adjacently positioned on the right side of the number 8 spot SP in the main scanning direction. The number 11 spot SP is positioned adjacent to, but spaced from the number 9 spot SP rightward in the main scanning direction. The number 13 spot SP is positioned adjacent to, but spaced from the number 11 spot SP rightward in the main scanning direction. The number 15 spot SP is positioned adjacent to, but spaced from the number 13 spot SP rightward in the main scanning direction.

Figure 16:
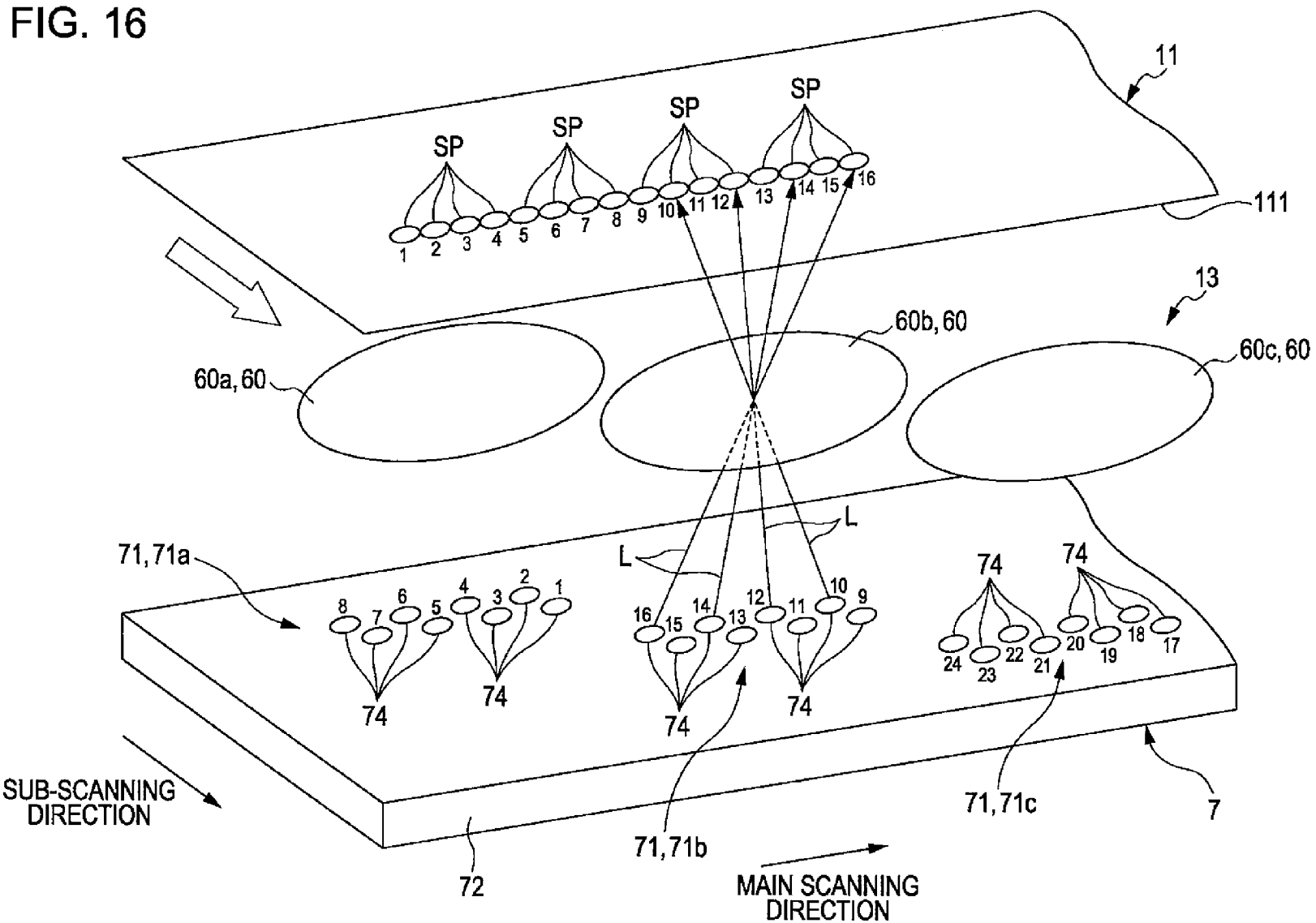
FIG. 16 is a schematic perspective view showing an operation state over time of the line head shown in FIG. 2.

Next, similarly to the above, the number 10, 12, 14, and 16 light emitting elements 74 emit light at the same time and for a predetermined time (for an instant) (refers to FIG. 16). By the light emission of these light emitting elements 74, four spots SP corresponding to the respective light emitting elements 74 are further formed on the light receiving surface 111 of the photoconductor drum 11. Therefore, the number 1 to 16 spots SP are disposed in one straight line shape along the main scanning direction in order from the left in FIG. 16.

Next, similarly to the above, the number 17, 19, 21, and 23 light emitting elements 74 emit light at the same time and for a predetermined time (for an instant) (refers to FIG. 17). By the light emission of these light emitting elements 74, four spots SP corresponding to the respective light emitting elements 74 are further formed on the light receiving surface 111 of the photoconductor drum 11.

The number 17 spot SP is adjacently positioned on the right side of the number 16 spot SP in the main scanning direction. The number 19 spot SP is positioned adjacent to, but spaced from the number 17 spot SP rightward in the main scanning direction. The number 21 spot SP is positioned adjacent to, but spaced from the number 19 spot SP rightward in the main scanning direction. The number 23 spot SP is positioned adjacent to, but spaced from the number 21 spot SP rightward in the main scanning direction.

Next, similarly to the above, the number 18, 20, 22, and 24 light emitting elements 74 emit light at the same time and for a predetermined time (for an instant) (refers to FIG. 18). Also, by the light emission of these light emitting elements 74, four spots SP corresponding to the respective light emitting elements 74 are further formed on the light receiving surface 111 of the photoconductor drum 11. Therefore, the number 1 to 24 spots SP are disposed in one straight line shape along the main scanning direction in order from the left in FIG. 18.

In this manner, in the line head 13, within one light emitting element group 71, the light emitting elements 74 of two light emitting element rows belonging to the light emitting element group are operated at the staggered light emission timing, and also, in one light emitting element group column, the light emitting element groups 71 are operated at the staggered light emission timing.

Also, as described above, a plurality of light emitting element groups 71 are disposed in high density, and, also within one light emitting element group 71, a plurality of light emitting elements 74 belonging to the light emitting element group are disposed with a high density.

Although the embodiment showing the line head and the image forming apparatus of the invention has been described above, the invention is not to be limited to this, but each of the sections constituting the line head and the image forming apparatus can be replaced with that of an arbitrary configuration capable of showing the same function. Further, an arbitrary structure may also be added.

Further, the lens array is not limited to a configuration in which a plurality of lenses are disposed in a matrix form of 3 rows by n columns, but, for example, the lenses may also be in a matrix form of 3 rows by n columns, 4 rows by n columns, or the like.

Further, in the lens array, at least two lenses of the lenses belonging to one column have different focal distances from each other. As a means of changing the focal distance, for example, a means of changing the radiuses of curvature (shape) of the convexly-curved surfaces of the lenses can be used.

Further, a lens protection member is not limited to a member made of a glass material, but it may also be made of any material, provided that the material is a substantially transparent material.

Further, although in the above-described embodiment, a case where there is a plurality of light emitting elements corresponding to one lens has been described, the invention is not limited to this, but one light emitting element may also be provided with respect to one lens.

Further, the number of the light emitting elements constituting one light emitting element group is not limited to eight, but, for example, it may also be two, three, four, five, six, seven, nine or more.

Further, each light emitting element group is not limited to a configuration in which the light emitting elements are disposed in a matrix fort, but, for example, may also be disposed in an arbitrary form which is different from a matrix form. For example, in a case where one light emitting element group is constituted of three light emitting elements, these three light emitting elements may also be disposed such that a line connecting their centers forms a triangle.

Further, each light emitting element is not limited to an element which is constituted of an organic EL element, but, for example, it may also be constituted of a light emitting diode (LED).

EXAMPLE

Next, the example of the invention is described.

1. Manufacturing of Image Forming Apparatus

Example 1

Making of Lens 64

The lens 64 which is of a circular shape in a plan view was made by forming a resin layer made of a resin material on one side surface of a flat plate-like glass substrate made of a glass material and forming the lens face 62 on the surface of the resin layer on the side opposite to the glass substrate.

At this time, in the lens face 62 of the lens 64, a region having a radius in the range of 0.0 to 0.604 mm with the optical axis as a center was set to be the first region 621, and a region outside the radius of 0.604 mm was set to be the second region 622.

The shape of the first region 621 is an aspheric shape and was defined by a definition expression which substituted c=1/1.498749, K=−0.99931244, A=−0.01825629, B=0.083801118, C=−0.1, and Δ=0.0 into the above-mentioned Formula (1).

Further, the shape of the second region 622 is an aspheric shape and was defined by a definition expression which substituted c=1/1.517423, K=−1.21004, A=0.007269, B=0.0, C=0.0, and Δ=0.001385889 into the above-mentioned Formula (1).

Further, 0.5ω was 0.261 deg, and Δθ was 0.291 deg.

Making of Lens 64'

The lens 64' was made by forming a resin layer made of a resin material on one side surface of a flat plate-like glass substrate made of a glass material and forming the lens face 62' on the surface of the resin layer on the side opposite to the glass substrate.

The shape of the lens face 62' is a freely curved surface (xy polynomial expression surface) and was defined by a definition expression which substituted c=1/1.41337, K=−3.8946025, A=0.03959898, B=0.035508266, C=0.11256865, D=0.2034097, E=0.1094741, F=−0.07921190, G=−0.2126654, H=−0.2376198, and I=−0.078115926 into Formula (2) described below.

[Formula 2]

$$\frac{cr^2}{1+\sqrt{1-(1+K)c^2r^2}} + Ax^2 + By^2 + Cx^4 + Dx^2y^2 + Ey^4 + Fx^6 + Gx^4y^2 + Hx^2y^4 + Iy^6 \quad (2)$$

However, $r^2=x^2+y^2$. Also, in Formula (2), x is a main direction (main scanning direction) coordinate, y is a sub-direction (sub-scanning direction) coordinate, c is curvature on the optical axis, K is a conic constant, and each of A to I is an aspheric coefficient.

Making of Line Head

The line head 13 as shown in FIG. 19 was formed by combining the lenses 64 and 64' having the shapes as described above. Further, in FIG. 19, one optical system is shown as a representative, and with respect to the other optical systems, representation is omitted. Further, FIG. 19 is a cross-sectional view of the optical system 60 and shows a main scanning direction cross-section including the optical axis of the optical system 60.

As shown in FIG. 19, the line head 13 has, in order from the left, the light emitting element array 7 in which the light emitting element group 71 (a plurality of light emitting elements 74) is provided, the diaphragm 82, the lens 64, and the lens 64'(the optical system 60). Further, the object side numerical aperture of the optical system 60 is 0.153 and the magnification is −0.5039.

In this example, the light emitting element group 71 was constituted of three light emitting elements 74. One light emitting element 74 (light emitting element 741) of the three light emitting elements was provided on the optical axis 601 of the optical system 60, and the other two light emitting elements 74 (light emitting elements 742 and 743) were provided on the opposite sides with respect to the light emitting element 741 and spaced with equal distances from the light emitting element 741 (optical axis 601). Further, the diameter of each light emitting element 74 was 40 μm.

The wavelength of the light which is emitted from each light emitting element 74 was set to be 690 nm (hereinafter, this wavelength is also referred to as a "reference wavelength"). Further, the overall width w (length in the main scanning direction) of the light emitting element group 71 was 1.176 mm.

Further, the light emitting element center-to-center distance in the main direction is set to be 0.042 mm, so that 0.5ω is equal to 0.261 deg. On the other hand, the shapes of the first and second regions 621 and 622 of the lens face 62 are defined such that an angle difference, Δθ, between the tangent lines at the lens boundary portion is equal to 0.291 deg, and the relationship of 0.5ω<Δθ is satisfied.

Such a line head 13 was incorporated into the image forming apparatus shown in FIG. 1, along with the photoconductor drum 11. At this time, the photo conductor 11 was disposed such that the light receiving surface 111 thereof is positioned within the small spot diameter region T, as described above.

Here, as shown in FIG. 19, when the left face of the light emitting element array 7 (the face on which the light emitting element group 71 is formed) is S1, the right face of the light emitting element array 7 is S2, the face of the diaphragm 82 is S3, the lens face 62 of the lens 64 is S4, the boundary face between the glass substrate and the resin layer of the lens 64 is S5, the flat face (right face) of the lens 64 is S6, the lens face 62' of the lens 64' is S7, the boundary face between the glass substrate and the resin layer of the lens 64' is S8, the flat face (right face) of the lens 64' is S9, and the light receiving surface 111 of the photoconductor 11 is S10, the faces S1 to S10 have configurations as shown in Table 1 stated below.

Further, when the face distance (separation distance) of the face S1 and the face S2 is d1, the face distance of the face S2 and the face S3 is d2, the face distance of the face S3 and the face S4 is d3, the face distance of the face S4 and the face S5 is d4, the face distance of the face S5 and the face S6 is d5, the face distance of the face S6 and the face S7 is d6, the face distance of the face S7 and the face S8 is d7, the face distance of the face S8 and the face S9 is d8, and the face distance of the face S9 and the face S10 is d9, d1 to d9 have the values as shown in Table 1 stated below.

TABLE 1

| Face Number | Description | Main Cross-section Center Curvature | Face Distance | Reference Wavelength Refractive Index |
|---|---|---|---|---|
| S1 | light source face | r1 = ∞ | d1 = 0.55 | n1 = 1.499857 |
| S2 | exit face of glass substrate | r2 = ∞ | d2 = 4.2535 | |
| S3 | opening diaphragm | r3 = ∞ | d3 = 0.01 | |
| S4 | incident face of lens resin portion | r4 = separately described | d4 = 0.3 | n4 = 1.525643 |
| S5 | resin-glass boundary face | r5 = ∞ | d5 = 0.9 | n5 = 1.536988 |
| S6 | exit face of lens | r6 = ∞ | d6 = 1.4276 | |
| S7 | incident face of lens resin portion | r7 = separately described | d7 = 0.3 | n7 = 1.525643 |
| S8 | resin-glass boundary face | r8 = ∞ | d8 = 0.9 | n8 = 1.536988 |
| S9 | exit face of lens | r9 = ∞ | d9 = 0.88527 | |
| S10 | image face | r10 = ∞ | | |

Comparative Example 1

Comparative Example 1 is the same as Example 1 except that it uses a lens 64" instead of the lens 64 and d9 is 0.88896.

Making of Lens 64"

The lens 64" was made by forming a resin layer made of a resin material on one side surface of a flat plate-like glass substrate made of a glass material and forming a convexly-curved surface (lens face) 62" on the surface of the resin layer on the side opposite to the glass substrate. This lens 64" is a lens having one focal point.

The shape of the lens face 62" is an aspheric surface which is rotationally symmetrical about the optical axis, and was defined by a definition expression which substituted c=1/1.50321, K=−1.432045, A=0.008079811, B=0.01631843, C=−0.01348224, and Δ=0 into the above-mentioned Formula (1).

2. Various Measurements 2-1. Change in Spot Diameter in Optical Axis Direction

With respect to each of Example 1 and Comparative Example 1, a change in the spot diameter in the optical axis direction was evaluated by simulation. The results are shown in FIGS. 20A and 20B.

3. Results

As shown in FIGS. 20A and 20B, in any of the light emitted from the light emitting element 741 positioned on the optical axis and the light emitted from the other light emitting elements 742 and 743, a region (small spot diameter region) having the spot diameter of 35 μm or less is formed in a wider area in the optical axis direction in Example 1 as compared with Comparative Example 1.

Further, as shown in FIGS. 20A and 20B, in any of the light emitted from the light emitting element 741 positioned on the optical axis and the light emitted from the other light emitting elements 742 and 743, a change in the spot diameter within the small spot diameter region is smaller in Example 1 as compared with Comparative Example 1.

In particular, in Example 1, in the light emitted from the light emitting element 741, the spot diameter is almost constant in the section of −20 to 10 of the abscissa axis, and in the light emitted from the other light emitting elements 742 and 743, the spot diameter is almost constant in the range of −20 to 20 on the abscissa axis. That is, in Example 1, in the range of −20 to 10 on the abscissa axis, the spot diameter of the light emitted from the light emitting element 741 and the spot diameter of the light emitted from the other light emitting elements 742 and 743 are constant together.

Further, as shown in FIGS. 20A and 20B, a difference between the spot diameter of the light emitted from the light emitting element 741 and the spot diameter of the light emitted from the other light emitting elements 742 and 743 in the range of −20 to 10 on the abscissa axis is smaller in Example 1 as compared with Comparative Example 1.

From the above, when an image is recorded on the recording medium P, there is an expectation that an image will be formed which has smaller density unevenness and is sharper in Example 1 than in Comparative Example 1.

The entire disclosure of Japanese Patent Applications No. 2009-012420, filed on Jan. 22, 2009 is expressly incorporated by reference herein.

What is claimed is:

1. A line head comprising:

first and second light emitting elements disposed in a first direction; and an optical system that images the light emitted from the first and second light emitting elements, wherein the optical system includes a rotationally symmetrical lens having a lens face including first and second regions that are defined by different definition expressions;

the first region is formed to include an intersection point of the lens face with the symmetry axis of the rotationally symmetrical lens;

the second region is formed to surround the periphery of the first region; and a first chief ray of a first light flux which is emitted from the first light emitting element and imaged by the optical system, a second chief ray of a second light flux that is emitted from the second light emitting element and imaged by the optical system, and the shape of the boundary portion between the first region and the second region of the lens face have the following relationship:

$$0.5\omega<\Delta\theta$$

wherein in the above formula, $\omega$ is a first direction angle that the first chief ray makes with the second chief ray, and $\Delta\theta$ is an angle that a tangent line to the first region at the boundary portion makes with a tangent line to the second region at the boundary portion in a first direction cross-section including the symmetry axis.

2. The line head according to claim 1, wherein three or more light emitting elements including the first light emitting element and the second light emitting element are disposed in the first direction, and the first light emitting element and the second light emitting element are disposed adjacent to each other in the first direction.

3. The line head according to claim 2, wherein a light emitting element where a separation distance in the first direction from the symmetry axis is the shortest, among the three or more light emitting elements, is the first light emitting element.

4. The line head according to claim 1, wherein when the rotationally symmetrical lens is viewed from the direction of the symmetry axis, the area of the second region is smaller than the area of the first region.

5. The line head according to claim 1, wherein the $\Delta\theta$ has the relationship of $\Delta\theta>0.261$.

6. An image forming apparatus comprising:

a latent image supporting body on that a latent image is formed; and a line head that exposes the latent image supporting body, thereby forming the latent image, wherein the line head includes first and second light emitting elements disposed in a first direction, and an optical system that images the light emitted from the first and second light emitting elements;

the optical system includes a rotationally symmetrical lens having a lens face including first and second regions that are defined by different definition expressions;

the first region is formed to include an intersection point of the lens face with the symmetry axis of the rotationally symmetrical lens;

the second region is formed to surround the periphery of the first region; and a first chief ray of a first light flux that is emitted from the first light emitting element and imaged by the optical system, a second chief ray of a second light flux that is emitted from the second light emitting element and imaged by the optical system, and the shape of the boundary portion between the first region and the second region of the lens face have the following relationship:

$$0.5\omega<\Delta\theta$$

wherein in the above formula, $\omega$ is a first direction angle that the first chief ray makes with the second chief ray, and $\Delta\theta$ is an angle that a tangent line to the first region at the boundary portion makes with a tangent line to the second region at the boundary portion in a first direction cross-section including the symmetry axis.

* * * * *